US011522294B2

(12) United States Patent
Sayama et al.

(10) Patent No.: US 11,522,294 B2
(45) Date of Patent: Dec. 6, 2022

(54) ANTENNA SYSTEM

(71) Applicant: AGC Inc., Tokyo (JP)

(72) Inventors: Toshiki Sayama, Tokyo (JP); Ryota Okuda, Tokyo (JP); Takeshi Motegi, Tokyo (JP); Osamu Kagaya, Tokyo (JP)

(73) Assignee: AGC INC., Tokyo (JP)

( * ) Notice: Subject to any disclaimer, the term of this patent is extended or adjusted under 35 U.S.C. 154(b) by 16 days.

(21) Appl. No.: 17/206,648

(22) Filed: Mar. 19, 2021

(65) Prior Publication Data

US 2021/0210857 A1 Jul. 8, 2021

Related U.S. Application Data

(63) Continuation of application No. PCT/JP2019/038814, filed on Oct. 1, 2019.

(30) Foreign Application Priority Data

Oct. 5, 2018 (JP) ..... JP2018-190375
Nov. 9, 2018 (JP) ..... JP2018-211308

(51) Int. Cl.
*H01Q 13/10* (2006.01)
*H01Q 1/32* (2006.01)
*H01Q 21/08* (2006.01)

(52) U.S. Cl.
CPC ..... *H01Q 13/10* (2013.01); *H01Q 1/32* (2013.01); *H01Q 21/08* (2013.01)

(58) Field of Classification Search
CPC .... H01Q 13/10; H01Q 1/1271; H01Q 1/1278; H01Q 1/1285; H01Q 1/32; H01Q 1/3208; H01Q 1/38; H01Q 21/08; H01Q 9/0457
See application file for complete search history.

(56) References Cited

U.S. PATENT DOCUMENTS 5,646,637 A 7/1997 Miller
10,054,792 B2 * 8/2018 Brandt ..... B60J 1/02
(Continued)

FOREIGN PATENT DOCUMENTS

EP 3 609 022 A1 2/2020
GB 2 271 139 A 4/1994
(Continued)

OTHER PUBLICATIONS

Ruddle, "Influence of dielectric materials on in-vehicle electromagnetic fields", IET Seminar Digests, Jan. 1, 2008 (Jan. 1, 2008), pp. 8-8, XP055839426, DOI: 10.1049/ic. 2008.0731.
Watanabe, et al., "First Demonstration of 28 GHz and 39 GHz Transmission Lines and Antennas on Glass Substrates for 5G Modules", 2017 IEEE 67th Electronic Components and Technology Conference (ECTC), IEEE, May 30, 2017 (May 30, 2017), pp. 236-241, XP033136057, DOI: 10.1109/ECTC. 2017.329 [retrieved on Aug. 1, 2017].
(Continued)

*Primary Examiner* — Jason Crawford
(74) *Attorney, Agent, or Firm* — Foley & Lardner LLP

(57) ABSTRACT

An antenna system includes a glass plate having a thickness of 1.1 mm or more and a dielectric loss tangent of 0.005 or more at 28 GHz, and an antenna located away from one of surfaces of the glass plate, wherein a ratio of electric power radiated from the antenna to electric power input into the antenna is defined as a radiation efficiency, and when an effective wavelength of an electromagnetic wave at a predetermined frequency is 10 GHz or more is denoted as $\lambda g$ and the radiation efficiency as $\eta_0$ [dB] when the glass plate and the antenna are in contact, and is denoted as $\eta_{\lambda g/2}$ [dB] when a distance between the one of the surfaces and the antenna is $\lambda g/2$, the glass plate and the antenna are arranged to obtain the radiation efficiency of $\eta_A$ [dB] that satisfies $\eta_A \geq \eta_0 + (\eta_{\lambda g/2} - \eta_0) \times 0.1$.

23 Claims, 17 Drawing Sheets

(56) References Cited

U.S. PATENT DOCUMENTS

| | | | | |
|---|---|---|---|---|
| 10,714,809 | B2 * | 7/2020 | Takahashi | H01Q 1/1271 |
| 2008/0129619 | A1 * | 6/2008 | Lee | H01Q 21/26 343/810 |
| 2012/0044113 | A1 * | 2/2012 | Satoh | H01Q 9/0407 343/893 |
| 2013/0257664 | A1 * | 10/2013 | Kagaya | H01Q 13/10 343/720 |
| 2015/0357700 | A1 * | 12/2015 | Kagaya | H01Q 1/1285 343/770 |
| 2016/0006112 | A1 * | 1/2016 | Kagaya | H01Q 1/1278 343/712 |
| 2017/0036646 | A1 * | 2/2017 | Kagaya | B60S 1/586 |
| 2019/0261464 | A1 * | 8/2019 | Noda | H01Q 1/1285 |
| 2021/0210857 | A1 * | 7/2021 | Sayama | H01Q 1/1271 |
| 2021/0273321 | A1 * | 9/2021 | Takeuchi | B32B 27/36 |
| 2022/0059948 | A1 * | 2/2022 | Sayama | H01Q 13/08 |

FOREIGN PATENT DOCUMENTS

| | | | |
|---|---|---|---|
| JP | 2005-033475 | A | 2/2005 |
| JP | 2016-025585 | A | 2/2016 |
| WO | WO-2017/188415 | A1 | 11/2017 |

OTHER PUBLICATIONS

International Searching Authority, "International Search Report," issued in connection with International Patent Application No. PCT/JP2019/038814, dated Dec. 17, 2019.

International Searching Authority, "Written Opinion," issued in connection with International Patent Application No. PCT/JP2019/038814, dated Dec. 17, 2019.

* cited by examiner

ANTENNA SYSTEM

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2019/038814 filed on Oct. 1, 2019 and designating the U.S., which claims priority to Japanese Patent Application No. 2018-190375 filed on Oct. 5, 2018 and Japanese Patent Application No. 2018-211308 filed on Nov. 9, 2018. The entire contents of the foregoing applications are incorporated herein by reference.

BACKGROUND OF THE INVENTION

1. Field of the Invention

The present invention relates to an antenna system.

2. Description of the Related Art

In recent years, there is an ongoing trend of expansion of services using high-speed and large-capacity wireless communication systems communicating in microwave and millimeter wave frequency bands, such as a trend of transition from 4G LTE to 5G (sub6). Specifically, the bandwidth used for such services tends to expand from the 3 GHz band to the 5 to 6 GHz band. An antenna that can support such frequency bands with a high directivity and a high reception sensitivity is desired. V2X (Vehicle to Everything), which is expected to be used as vehicle-to-vehicle communication and road-to-vehicle communication, has been developed for various purposes such as, e.g., an electronic toll collection (ETC) system in 5.9 GHz band in Europe. In addition, attempts have been made to spread wireless communication systems that use frequencies higher than sub6 (for example, 28 GHz band, 40 GHz band, 60 GHz band, and 70 GHz band).

In order to perform such high frequency band communication, for example, when a millimeter wave radar mounted on a car performs transmission and reception, an attenuation in the gain may occur due to window glass, which does not occur significantly with conventional frequency band communication. Therefore, in order to obtain a higher gain, a configuration in which an electromagnetic wave transmitting material is embedded in a portion of a window glass is disclosed (see for example, International Publication No. 2017/188415).

SUMMARY OF THE INVENTION

Technical Problem

However, the technique of International Publication No. 2017/188415 has a problem in that the configuration becomes complicated because the window glass itself is mechanically processed and a member other than the window glass is included in a portion where the window glass is normally present.

In view of the above, the present disclosure provides an antenna system that transmits and receives electromagnetic waves in a predetermined radio frequency band with the use of a conventional glass plate with a thickness of 1.1 mm or more and a dielectric loss tangent of 0.005 or more at 28 GHz without complicating the configuration of the glass plate.

Solution to Problem

The present disclosure provides an antenna system including:

a glass plate having a thickness of 1.1 mm or more and having a dielectric loss tangent of 0.005 or more at 28 GHz; and an antenna located away from one of surfaces of the glass plate, wherein a ratio of electric power radiated from the antenna to electric power input into the antenna is defined as a radiation efficiency, and wherein where an effective wavelength of an electromagnetic wave at a predetermined frequency that is 10 GHz or more is denoted as $\lambda g$, and where the radiation efficiency is denoted as $\eta_0$ [dB] when the glass plate and the antenna are in contact with each other, and is denoted as $\eta_{\lambda g/2}$ [dB] when a distance between the one of the surfaces and the antenna is $\lambda g/2$, the glass plate and the antenna are arranged so as to obtain the radiation efficiency of $\eta_A$ [dB] that satisfies $\eta_A \geq \eta_0 + (\eta_{\lambda g/2} - \eta_0) \times 0.1$.

Advantageous Effects of Invention

According to the technique of the present disclosure, an antenna system can be provided that transmits and receives electromagnetic waves in a predetermined radio frequency band with the use of a conventional glass plate with a thickness of 1.1 mm or more and a dielectric loss tangent of 0.005 or more at 28 GHz without complicating the configuration of the glass plate.

MODES FOR CARRYING OUT THE INVENTION

Hereinafter, an embodiment according to the present disclosure is described with reference to drawings. In the embodiment, deviations from directions such as parallel direction, perpendicular direction, orthogonal direction, horizontal direction, vertical direction, height direction, width direction, and the like are tolerated so long as the effects of the present invention are not impaired. Further, an X axis direction, a Y axis direction, and a Z axis direction represent a direction parallel to the X axis, a direction parallel to the Y axis, and a direction parallel to the Z axis, respectively. The X axis direction, the Y axis direction, and the Z axis direction are orthogonal to each other. The XY plane, the YZ plane, and the ZX plane are a virtual plane parallel to the X axis direction and the Y axis direction, a virtual plane parallel to the Y axis direction and the Z axis direction, and a virtual plane parallel to the Z axis direction and the X axis direction, respectively.

The antenna system of the present invention is not limited to an antenna system for a vehicle, and may be antenna systems for buildings or electronic devices. In the following explanation of the embodiment of the present disclosure, an antenna system for a vehicle is adopted as a typical example.

The antenna for the vehicle according to the embodiment of the present disclosure is suitable for transmitting and receiving electromagnetic waves in radio frequency bands such as microwaves and millimeter waves (for example, 0.3 GHz to 300 GHz, and in particular, radio frequency bands in 10 GHz or higher, such as 28 GHz and 39 GHz). The antenna for the vehicle according to the embodiment of the present disclosure can be applied to, for example, a V2X communication system, a fifth generation mobile communication system (i.e., what is termed as "5G"), a vehicle-mounted radar system, and the like, but the system to which the antenna for the vehicle according to the embodiment of the present disclosure can be applied is not limited thereto. An example of a V2X communication system is an electronic toll collection (ETC) system.

Figure 1:
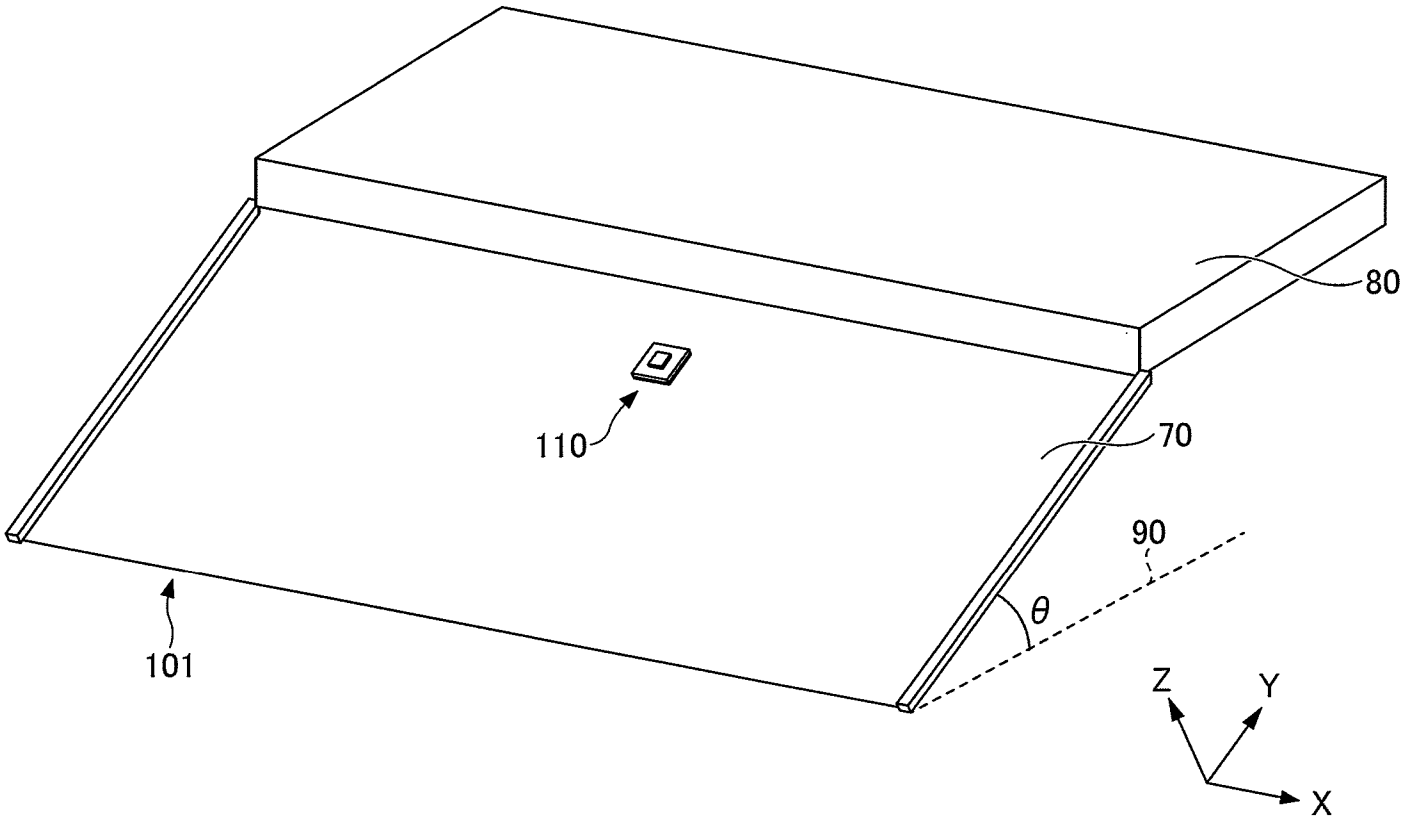
FIG. 1 is a perspective view illustrating an antenna system.

FIG. 1 is a perspective view illustrating an example of an antenna system according to the embodiment of the present disclosure. The antenna system 101 as illustrated in FIG. 1 includes a glass plate 70 for window of a vehicle 80; and an antenna 110 for a vehicle (which may be hereinafter simply referred to as an "antenna 110") attached to the glass plate 70.

The glass plate 70 has a thickness (T) of 1.1 mm or more, and has a dielectric loss tangent (referred to as "tan δ") of 0.005 or more at 28 GHz. The glass plate 70 is, for example, a windshield provided on the front side of the vehicle 80. The glass plate 70 is attached to a window frame on the front side of the vehicle 80 with a predetermined arrangement angle θ with respect to a horizontal plane 90. The upper limit of the thickness (T) of the glass plate 70 is not particularly limited, but, for example, when the glass plate 70 is a vehicle-use glass plate, and the glass plate 70 is constituted by a single glazing, the thickness (T) of the glass plate 70 is usually 5 mm or less. When the glass plate is constituted by an insulated glazing with a structure obtained by laminating two panes of glass, the maximum thickness of the glass plate 70 is about 10 mm or less (5 mm×2). Depending on the purpose, the thickness of the glass plate 70 may be 2 mm or more, or 3 mm or more. When the glass plate 70 is constituted by an insulated glazing, for example, the thickness of the glass plate 70 is 4 mm or more (2 mm×2 or more), or may be 6 mm or more (3 mm×2 or more).

The dielectric loss tangent (tanδ) is a value measured at 25 degrees Celsius at 28 GHz using a cavity resonator and a vector network analyzer by a method specified in Japanese Industrial Standards (JIS R 1641: 2007). Unless otherwise specified, the value of dielectric loss tangent (tanδ) in the present specification shall be a value measured according to the above Standards at 25 degrees Celsius at 28 GHz.

The composition of the glass constituting the glass plate 70 is not particularly limited, but the composition of the glass plate 70 may include, as expressed in oxide-based mol %, 50 to 80% of $SiO_2$, 0 to 10% of $B_2O_3$, 0.1 to 25% of $Al_2O_3$, totally 3 to 30% of at least one type of alkali metal oxide selected from the group consisting of $Li_2O$, $Na_2O$, or $K_2O$, 0 to 25% of MgO, 0 to 25% of CaO, 0 to 5% of SrO, 0 to 5% of BaO, 0 to 5% of $ZrO_2$, and 0 to 5% of $SnO_2$.

The antenna 110 is located away from one of the surfaces of the glass plate 70. For example, the antenna 110 is attached to the interior side of the glass plate 70 with a member such as a housing and the like, not illustrated, so that the antenna 110 is located away from the interior-side surface of the glass plate 70. In this example, the antenna 110 is attached to an approximately central portion in an upper area of the glass plate 70. In this example, a single antenna 110 is attached to the glass plate 70, but multiple antennas 110 may be attached to the glass plate 70. Where a wavelength of an electromagnetic wave at a predetermined frequency of 10 GHz or more transmitted and received by the antenna 110 is denoted as λ0, a distance D between the one of the surfaces of the glass plate 70 and the antenna 110 is preferably 2×λ0 or less in terms of low profile considerations. More preferably, the distance D is 1.5×λ0 or less, and still more preferably, the distance D is 1.0×λ0 or less.

In this example, the antenna 110 is indirectly attached to the interior-side surface of the glass plate 70 via an attachment member, not illustrated, but as long as the antenna 110 is attached to a position away from the interior-side surface of the glass plate 70, the antenna 110 may be attached to other attachment portions. For example, the antenna 110 may be attached to the ceiling of the vehicle 80, a rearview mirror, or the like. Even when the antenna 110 is attached to such an attachment portion, the distance D from the glass plate 70 may be 2×λ0 or less. More preferably, the distance D is 1.5×λ0 or less, and still more preferably, the distance D is 1.0×λ0 or less. The distance D is preferably in the above range even when a matching layer and a spacer explained later are interposed between the glass plate 70 and the antenna 110.

Figure 2:
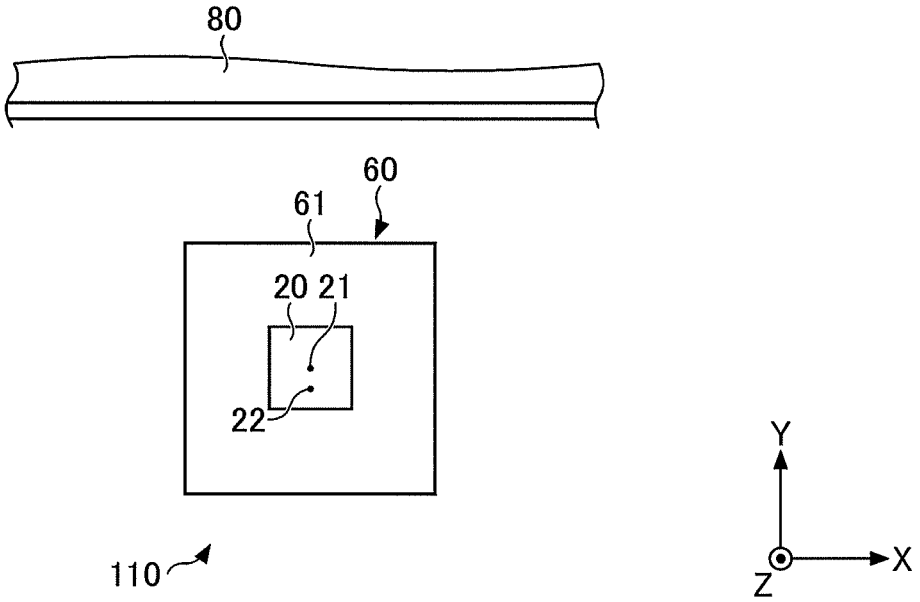
FIG. 2 is a front view of an antenna.
Figure 3:
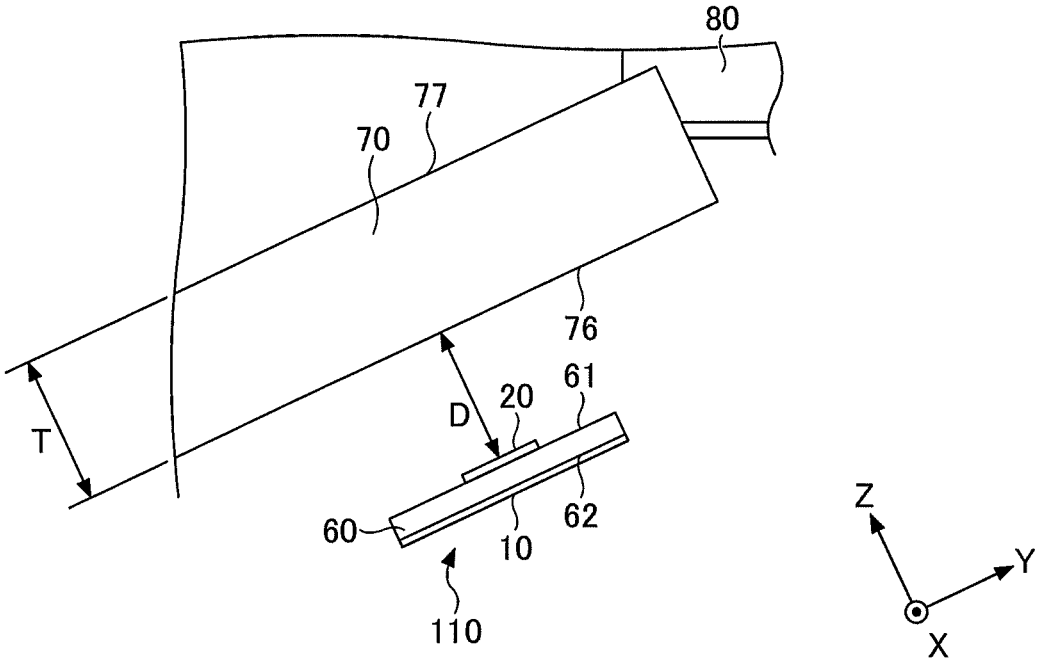
FIG. 3 is a side view of an antenna.

FIG. 2 is a drawing illustrating the antenna in a front view. FIG. 3 is a drawing illustrating the antenna in a side view. The antenna 110 illustrated in FIGS. 2, 3 is arranged at a position away from the interior-side surface 76 of the glass plate 70. The glass plate 70 includes the interior-side surface 76 at an interior side of the vehicle 80 and an exterior-side surface 77 at an exterior side of the vehicle 80. The interior-side surface 76 is the one of the surfaces of the glass plate 70. The exterior-side surface 77 is a surface on the opposite side from the one of the surfaces of the glass plate 70. The plate thickness T denotes the thickness of the glass plate 70, and is 1.1 mm or more as explained above.

The distance D is the shortest distance between the interior-side surface 76 and the antenna 110. In the case of FIG. 3, the distance D denotes the shortest distance between the radiation plate 20 and the interior-side surface 76. The antenna 110 is arranged away from the glass plate 70, and accordingly, the distance D is more than zero. In other words, when the distance D is zero, the antenna 110 is in contact with the interior-side surface 76. Note that the antenna 110 may be arranged parallel to or non-parallel to the interior-side surface 76, and even when the antenna 110 is arranged non-parallel, the distance D represents the shortest distance between the radiation plate 20 and the interior-side surface 76. In other words, when the main radiation source of electromagnetic waves from the antenna 110 is the surface of the radiation plate 20, the distance D may be the shortest distance between the radiation plate 20 and the interior-side surface 76 as described above. The radiation plate 20 is an example for radiating electromagnetic waves at a predetermined frequency of 10 GHz or more, and in the present specification, not only the radiation plate 20 but also a slot for radiating electromagnetic waves at approximately the same frequency are collectively referred to as a "radiation unit 20".

An aspect in which the antenna 110 is located away from one of the surfaces of the glass plate 70 (i.e., the interior-side surface 76 in the case of FIG. 3) includes, as long as an adhesive member for bonding the antenna 110 with the one of the surfaces has a finite thickness, an aspect in which the adhesive member is interposed between the antenna 110 and the one of the surfaces. In this case, (the shortest distance of) the thickness of the adhesive member corresponds to the distance D. Examples of adhesive members include adhesive agents, pressure-sensitive adhesive agents, adhesive tapes, and the like. In other words, an aspect in which the antenna 110 is located away from one of the surfaces of the glass plate 70 includes an aspect in which the antenna 110 is in contact with the one of the surfaces via an interposing member such as an adhesive member and the like.

Examples of adhesive members include acrylic resin, rubber, silicone resin, butadiene resin, epoxy resin, polyurethane resin, polyvinyl acetal resin, polyvinyl chloride resin, ionomer, polyester resin, ethylene-vinyl acetate copolymer resin, ethylene-ethyl acrylic copolymer resin, polycycloolefin resin, and the like. Among them, only one type may be used, or two or more types may be used in combination.

In this case, a ratio of radiated electric power radiated from the antenna 110 to input electric power input into the antenna 110 is defined as a radiation efficiency. The input electric power input to the antenna 110 represents the electric power received by the antenna 110 from among the electric power fed to the antenna 110. Therefore, for example, the electric power lost in a transmission line such as a coaxial cable and a microstrip line connected to the antenna 110 is not included in the above "input electric power input to the antenna 110". As a result of the research conducted by the inventors of the present application, the inventors have found that the radiation efficiency is related to the plate thickness T and the distance D.

An effective wavelength of electromagnetic waves at a predetermined frequency of 10 GHz or more is denoted as λg. When the medium between the antenna 110 and the glass plate 70 is air, the effective wavelength λg is the same as a wavelength λ0 in a vacuum (i.e., λg=λ0). However, when, other than air, a dielectric such as a matching layer and a spacer explained later is present or a dielectric and a metal are present between the antenna 110 and the glass plate 70, the effective wavelength λg means a wavelength in view of a wavelength shortening rate (i.e., a velocity factor) of such a material. The matching layer and the spacer may be formed by a coating such as a dry coating or a wet coating.

In this case, when the glass plate 70 and the antenna 110 are in contact with each other (i.e., D=0), a radiation efficiency is denoted as $\eta_0$ [dB]. When the distance between one of the surfaces of the glass plate 70 and the antenna 110 is λg/2 (i.e., D=λg/2), a radiation efficiency is denoted as $\eta_{\lambda g/2}$ [dg]. The inventors of the present application have found that, when the glass plate 70 and the antenna 110 are arranged to obtain a radiation efficiency $\eta_A$ [dB] satisfying "$\eta_A \geq \eta_0+(\eta_{\lambda g/2}-\eta_0)\times 0.1$", electromagnetic waves at a radio frequency band of 10 GHz or more can be transmitted and received without processing the glass plate 70. Preferably, the radiation efficiency $\eta_A$ satisfies "$\eta_A \geq \eta_0+(\eta_{\lambda g/2}-\eta_0)\times 0.2$", and more preferably satisfies "$\eta_A \geq \eta_0+(\eta_{\lambda g/2}-\eta_0)\times 0.3$". An example of "without processing the glass plate 70" includes a case of not performing processing to partially reduce the thickness of the glass plate 70 in proximity to the antenna 110, and in normal circumstances, "without processing the glass plate 70" means that the state of the single glazing or the insulated glazing used is maintained.

In addition, the inventors of the present application have found that, when the glass plate 70 and the antenna 110 are arranged to obtain a radiation efficiency $\eta_A$ of −10 [dB] or more, electromagnetic waves at a radio frequency band of 10 GHz or more can be transmitted and received without processing the glass plate 70. Also, the inventors of the present application have found that, when the glass plate 70 and the antenna 110 are arranged to obtain a radiation efficiency $\eta_A$ of preferably −7 [dB] or more, more preferably −5 [dB] or more, still more preferably −3 [dB] or more, and yet still more preferably −1 [dB] or more, electromagnetic waves at a radio frequency band of 10 GHz or more can be transmitted and received without processing the glass plate 70.

Next, an example of configuration of the antenna 110 is explained in detail. The antenna 110 as illustrated in FIGS. 2, 3 includes at least the conductor plate 10 and the radiation plate 20.

Typically, the conductor plate 10 is a planar layer of which the surface is parallel to the XY plane, and functions as the ground of the antenna 110. The conductor plate 10 is a plate-shaped or film-shaped conductor. Examples of materials of conductors used for the conductor plate 10 include silver, copper, and the like, but are not limited thereto. Although the shapes of the conductor plates 10 illustrated in the drawings are squares in a plan view (i.e., as seen in the Z axis direction), the shapes may also be polygonal shapes other than a square, and may be other shapes such as circular shapes. In this case, "plate-shaped" or "film-shaped" may include shapes having three-dimensional shapes such as, for example, a protruding shape, a recessed shape, a wavy shape, and the like. This is also applicable to a conductor plate and a dielectric substrate explained later. However, "plate-shaped" or "film-shaped" explained above is preferably a planar shape (two-dimensional shape) because predetermined antenna gain characteristics can be easily predicted.

The radiation plate 20 is a plate-shaped or film-shaped conductor arranged to face the conductor plate 10 in the Z axis direction, and the size of area of the radiation plate 20 is smaller than the size of area of the conductor plate 10. The radiation plate 20 is a planar layer of which the surface is parallel to the XY plane, and functions as a radiating element of the antenna 110. Examples of materials of conductors used for the radiation plate 20 include silver, copper, and the like. However, the materials of the conductors are not limited thereto. Although the shapes of the radiation plates 20 illustrated in the drawings are squares in the plan views (i.e., as seen in the Z axis direction), the shapes may also be polygonal shapes other than a square, and may be other shapes such as circular shapes.

The radiation plate 20 is arranged away from the conductor plate 10. The medium between the conductor plate 10 and the radiation plate 20 includes either a space or a dielectric substrate, or includes both of the space and the dielectric substrate. FIGS. 2, 3 illustrate cases where the medium is constituted by only the dielectric substrate 60. In a case where the medium is space (air), the radiation plate 20 and the conductor plate 10 may be fixed by a housing, not illustrated, as necessary.

The dielectric substrate 60 is a plate-shaped or film-shaped dielectric layer of which the main component is a dielectric. The dielectric substrate 60 includes a first surface 61 and a second surface 62 on a side opposite to the first surface 61. The surfaces 61, 62 are parallel to the XY plane. The radiation plate 20 is provided on the surface 61, i.e., one of the surfaces of the dielectric substrate 60. The conductor plate 10 is provided on the surface 62, i.e., the other of the surfaces of the dielectric substrate 60.

The dielectric substrate 60 may be, for example, a dielectric substrate such as a glass epoxy substrate or a dielectric sheet. Examples of materials of dielectrics used for the dielectric substrate 60 include glass such as silica glass, ceramics, fluororesin such as polytetrafluoroethylene, liquid crystal polymer, cycloolefin polymer, and the like, but are not limited thereto. When the dielectric substrate 60 is a resin material, the surface of the resin may be coated with an ultraviolet absorbing layer, or an ultraviolet absorber may be added to the resin material in order to increase the ultraviolet resistance.

The antenna 110 is, for example, a planar antenna arranged so as to be parallel to the interior-side surface 76. When the antenna 110, i.e., the planar antenna, is arranged to be parallel to the interior-side surface 76 that is inclined with respect to the horizontal plane 90 (see FIG. 1), the antenna 110 can be easily implemented with a low profile.

For example, the antenna 110 is a planar antenna including the dielectric substrate 60, the radiation plate 20 arranged on the first surface 61, and the conductor plate 10 on the opposite side of the dielectric substrate 60 from the radiation plate 20. The planar antenna having such a structure is referred to as a patch antenna or a microstrip antenna.

Figure 4:
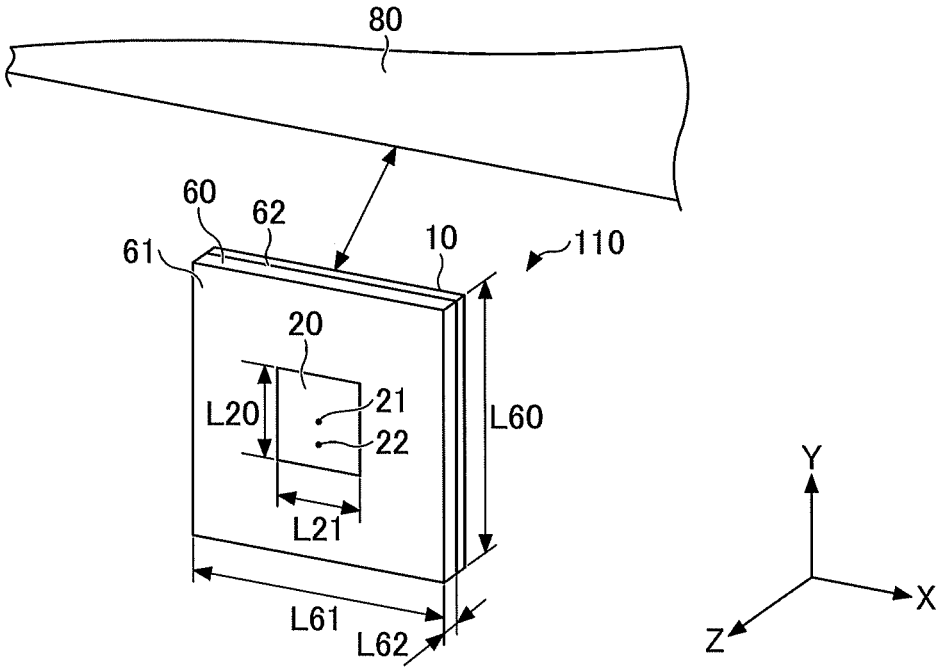
FIG. 4 is a perspective view of an antenna.
Figure 5:
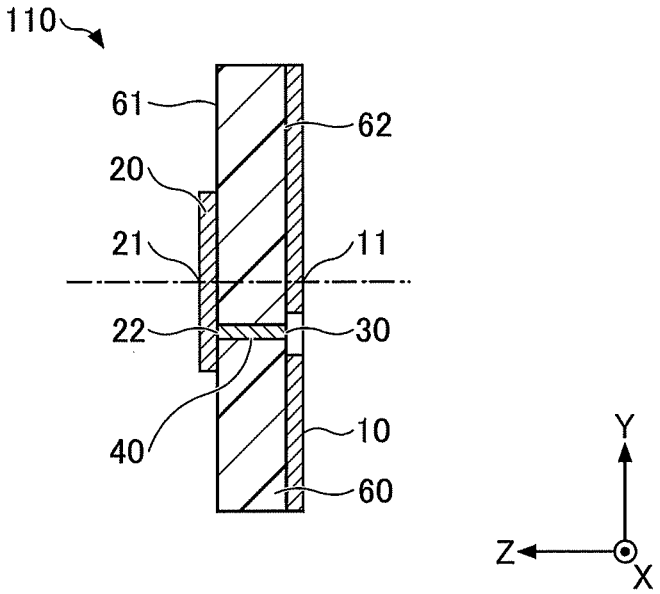
FIG. 5 is a cross-sectional view of an antenna.

FIG. 4 is a perspective view illustrating the antenna 110 including the dielectric substrate 60 formed with the conductor plate 10 and the radiation plate 20. FIG. 5 is a cross-sectional view illustrating the antenna 110 including the dielectric substrate 60 famed with the conductor plate 10 and the radiation plate 20. The antenna 110 includes a connection conductor 40 connecting the feeding portion 30 and the radiation plate 20 so as to penetrate a portion of the dielectric substrate 60.

The feeding portion 30 is a portion to be fed with or without contact, and is a portion that is brought into contact with or arranged in proximity to one end of a transmission line (not illustrated). Specific examples of transmission lines include a coaxial cable and a microstrip line. The other end of the transmission line is connected to a communication apparatus for communicating with the outside of the vehicle using the antenna 110. The feeding portion 30 is located on the same side as the conductor plate 10 with respect to the radiation plate 20.

The connection conductor 40 is not in contact with the conductor plate 10. One end of the connection conductor 40 is connected to the feeding portion 30, and the other end is connected to the radiation plate 20 at a connection point 22. The connection point 22 is shifted from a center of gravity 21 of the radiation plate 20. In the illustrated case, the connection point 22 is located on the negative side of the Y axis direction with respect to the center of gravity 21. The center of gravity 21 corresponds to the center of a symmetric figure when the radiation plate 20 has a symmetric figure such as a square.

Examples of the connection conductor 40 include a conductor formed in a through hole penetrating the dielectric substrate 60 in the Z axis direction, a core wire of a coaxial cable, and a conductor pin formed in a pin shape, but the connection conductor 40 is not limited thereto. When the medium between the conductor plate 10 and the radiation plate 20 includes an empty space, examples of the connection conductor 40 include a core wire of a coaxial cable and a conductor pin, but the connection conductor 40 is not limited thereto.

As illustrated in FIG. 5, the center of gravity 21 of the radiation plate 20 preferably overlaps with a center of gravity 11 of the conductor plate 10 as seen from a viewpoint on the side of the radiation plate 20 with respect to the conductor plate 10, in order to improve the antenna gain of the antenna 110 in the direction from the conductor plate 10 to the radiation plate 20. In this example, the viewpoint on the side of the radiation plate 20 with respect to the conductor plate 10 means a view point as seen from the positive side of the Z axis direction, and the direction from the conductor plate 10 to the radiation plate 20 means a direction toward the positive side of the Z axis direction.

As described above, the coaxial cable and the microstrip line have been explained as examples of the transmission line to the planar antenna, but hereinafter the transmission line is explained in a more specific manner. In the present specification, the planar antenna and the transmission line are collectively referred to as a "transmission line-attached antenna".

Figure 6A:
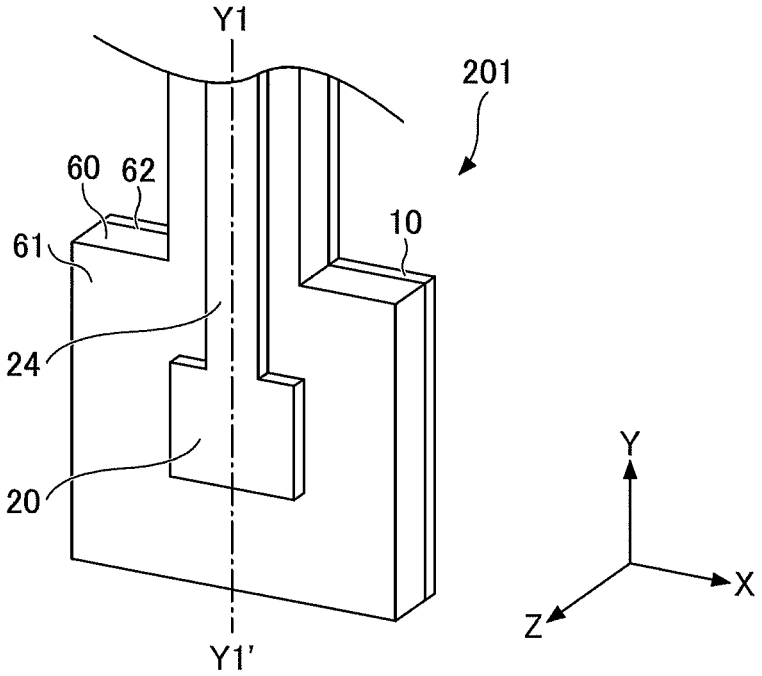
FIG. 6A is a perspective view of a transmission line-attached antenna.
Figure 6B:
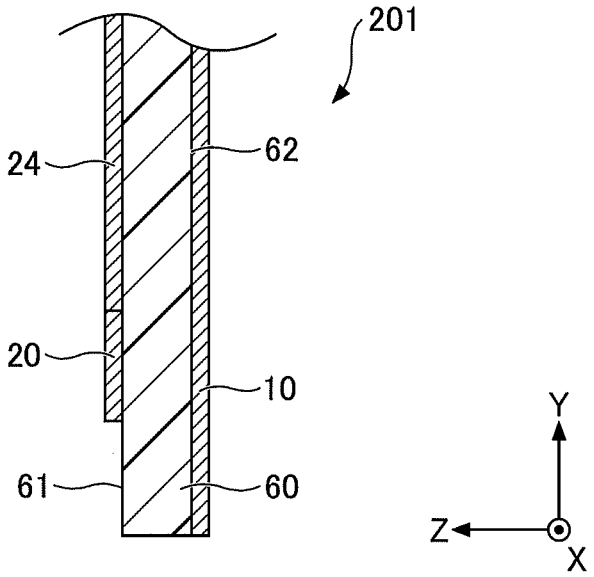
FIG. 6B is a cross-sectional view of a transmission line-attached antenna.

FIG. 6A is a perspective view illustrating a transmission line-attached antenna 201, and FIG. 6B is a cross-sectional view taken along Y1-Y1'. The transmission line-attached antenna 201 includes a dielectric substrate 60, a radiation plate 20 arranged on a first surface 61 of the dielectric substrate 60, and a microstrip line 24 arranged on the first surface 61 and connected to the radiation plate 20. The transmission line-attached antenna 201 includes a conductor plate 10 on a second surface 62 on the opposite side of the dielectric substrate 60 from the first surface 61, and functions as a ground. When a dielectric loss tangent (tanδ) of the dielectric substrate 60 (a first dielectric substrate 60*a* and a second dielectric substrate 60*b* explained later) is smaller, the transmission loss in the transmission line can be reduced. The dielectric loss tangent (tanδ) of the dielectric substrate 60 may be 0.03 or less, more preferably 0.008 or less, and still more preferably 0.001 or less.

In the transmission line-attached antenna 201, when the thickness of the dielectric substrate 60 is thinner, the radiation loss from the transmission line can be reduced more greatly, and accordingly, the transmission loss of the microstrip line 24 can be reduced more greatly. In particular, at a higher frequency, the effect of reducing the transmission loss is likely to become more significant. In particular, as compared with the case where air is interposed between the radiation plate 20 (i.e., the antenna 110) and the glass plate 70 as illustrated in FIG. 3, a configuration having a matching layer 74 or having both of the matching layer 74 and a spacer 75 between the radiation plate 20 (i.e., the antenna 110) and the glass plate 70 as explained later with reference to FIG. 12 to FIG. 14 can more greatly reduce the radiation loss from the transmission line when the thickness of the dielectric substrate 60 is thinner. Therefore, in the case of the configuration having the matching layer 74 or having both of the matching layer 74 and the spacer 75 between the radiation plate 20 (i.e., the antenna 110) and the glass plate 70, the transmission loss of the microstrip line 24 can be reduced more greatly when the thickness of the dielectric substrate 60 is thinner. The thickness of the dielectric substrate 60 may be 0.1×λ0 or less, more preferably 0.08×λ0 or less, and still more preferably 0.06×λ0 or less. Although the lower limit of the thickness of the dielectric substrate 60 is not particularly limited, the lower limit may be 0.01 mm or more for the ease of handling.

Figure 7A:
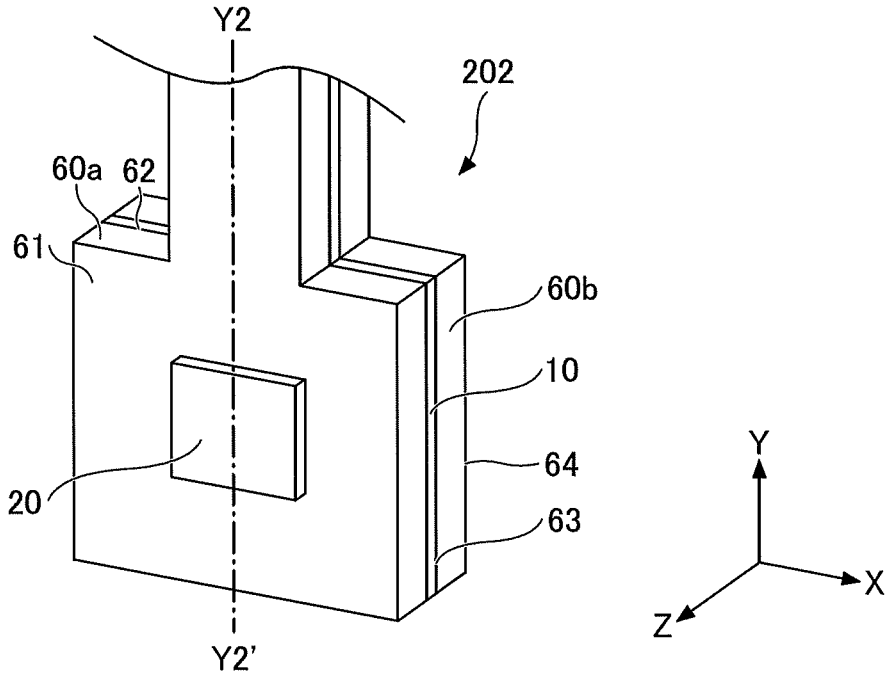
FIG. 7A is a perspective view of a transmission line-attached antenna.
Figure 7B:
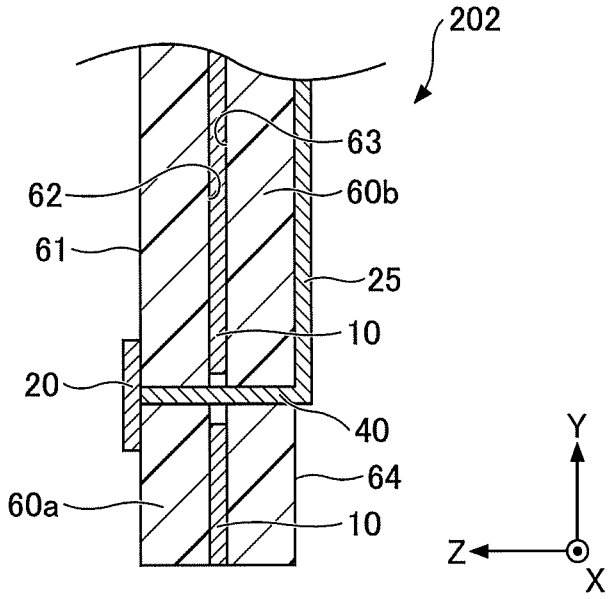
FIG. 7B is a cross-sectional view of a transmission line-attached antenna.

FIG. 7A is a perspective view illustrating a transmission line-attached antenna 202. FIG. 7B is a cross-sectional view taken along Y2-Y2'. The transmission line-attached antenna 202 includes a first dielectric substrate 60*a*, a second dielectric substrate 60*b*, a radiation plate 20, a conductor plate 10, a connection conductor 40, and a microstrip line 25. The first dielectric substrate 60*a* and the second dielectric substrate 60*b* are arranged to overlap with each other in the thickness direction. The first dielectric substrate 60*a* includes a first surface 61 on the opposite side from the second dielectric substrate 60*b* and a second surface 62 on the same side as the second dielectric substrate 60*b*. The second dielectric substrate 60*b* includes a third surface 63 on the same side as the first dielectric substrate 60*a* and a fourth surface 64 on the opposite side from the first dielectric substrate 60*a*. The first dielectric substrate 60*a* and the second dielectric substrate 60*b* may be made of different materials or may be made of the same material.

The transmission line-attached antenna 202 includes a radiation plate 20 arranged on the first surface 61, a connection conductor 40 connected to the radiation plate 20, and a microstrip line 25 connected to the connection conductor 40. The transmission line-attached antenna 202 includes, between the first dielectric substrate 60*a* and the second dielectric substrate 60*b*, a conductor plate 10 on the second surface 62 and the third surface 63. The conductor plate 10 functions as a ground. The connection conductor 40 is a conductor that extends in the thickness direction (i.e., the Z axis direction) of the first dielectric substrate 60*a* and the second dielectric substrate 60*b* to be formed in a through hole penetrating the first dielectric substrate 60*a*, the conductor plate 10, and the second dielectric substrate 60*b*. The connection conductor 40 is not connected to at least the conductor plate 10. Further, the microstrip line 25 is provided on the fourth surface 64.

In the transmission line-attached antenna 202, the microstrip line 25 is provided on the opposite side of the conductor plate 10 from the radiation plate 20 (i.e., on the minus side of the Z axis direction). Therefore, the transmission line-attached antenna 202 can reduce the transmission loss of the microstrip line 25 caused by a dielectric, not illustrated, provided between the radiation plate 20 and the glass plate 70 or caused by the glass plate 70.

Figure 8A:
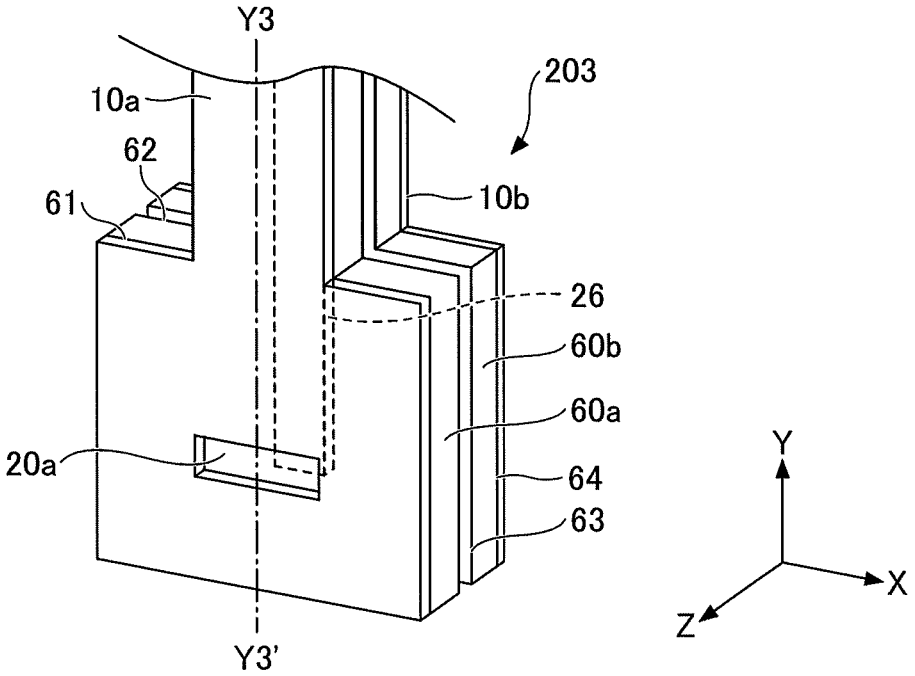
FIG. 8A is a perspective view of a transmission line-attached antenna.
Figure 8B:
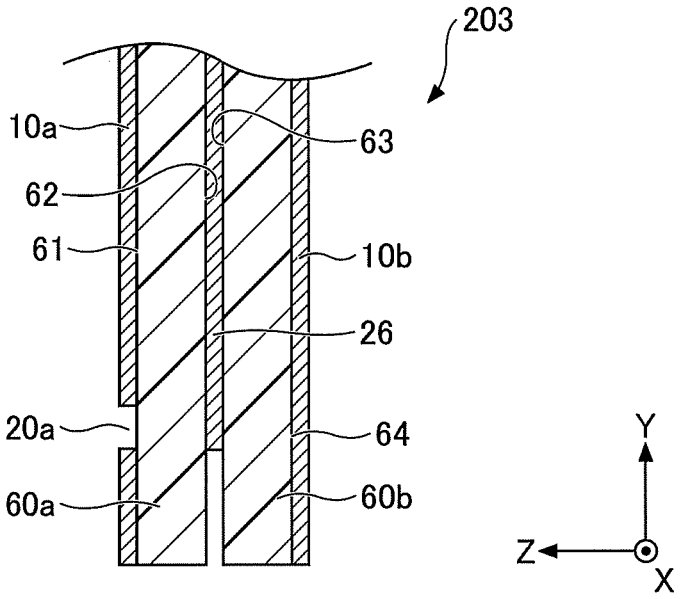
FIG. 8B is a cross-sectional view of a transmission line-attached antenna.

FIG. 8A is a perspective view illustrating a transmission line-attached antenna 203. FIG. 8B is a cross-sectional view taken along Y3-Y3'. The transmission line-attached antenna 203 includes a first dielectric substrate 60*a*, a second dielectric substrate 60*b*, a slot 20*a*, a first conductor plate 10*a*, a second conductor plate 10*b*, and a strip line 26. The first dielectric substrate 60*a* and the second dielectric substrate 60*b* are arranged to overlap with each other in the thickness direction. The first dielectric substrate 60*a* includes a first surface 61 on the opposite side from the second dielectric substrate 60*b* and a second surface 62 on the same side as the second dielectric substrate 60*b*. The second dielectric substrate 60*b* includes a third surface 63 on the same side as the first dielectric substrate 60*a* and a fourth surface 64 on the opposite side from the first dielectric substrate 60*a*. The first dielectric substrate 60*a* and the second dielectric substrate 60*b* may be made of different materials or may be made of the same material. In the transmission line-attached antenna 203, a slot 20*a* corresponds to the "radiation unit 20".

The transmission line-attached antenna 203 includes a strip line 26 provided between the second surface 62 and the third surface 63. The transmission line-attached antenna 203 includes a first conductor plate 10*a* on a first surface 61, so that the first conductor plate 10*a* overlaps with at least a portion of the strip line 26 as seen from the thickness direction (i.e., the Z axis direction) of the first dielectric substrate 60*a* and the second dielectric substrate 60*b*. The first conductor plate 10*a* functions as a ground. The transmission line-attached antenna 203 is a what is termed as a slot antenna that has the slot 20*a* formed with an opening in a portion of the first conductor plate 10*a*. In a plan view of the first conductor plate 10*a*, the slot 20*a* preferably overlaps with at least a portion of the strip line 26 (for example, an end portion). The slot 20*a* may be formed by a concave portion in which the first surface 61 is exposed, and in this case, the medium of the concave portion forming the slot 20*a* is air, but the concave portion may be filled with a dielectric material other than air. Further, the transmission line-attached antenna 203 includes a second conductor plate 10*b* on the fourth surface 64, so that the second conductor plate 10*b* overlaps with the slot 20*a* and the strip line 26, as seen in the thickness direction (i.e., the Z axis direction) of the first dielectric substrate 60*a* and the second dielectric substrate 60*b*. The second conductor plate 10*b* functions as a ground.

In the transmission line-attached antenna 203, the strip line is arranged between the first conductor plate 10*a* and the second conductor plate 10*b* as seen in the Z axis direction. Therefore, the transmission line-attached antenna 203 can reduce the transmission loss of the strip line 26 caused by a dielectric, not illustrated, provided between the first conductor plate 10*a* and the glass plate 70 and caused by the glass plate 70.

Figure 9A:
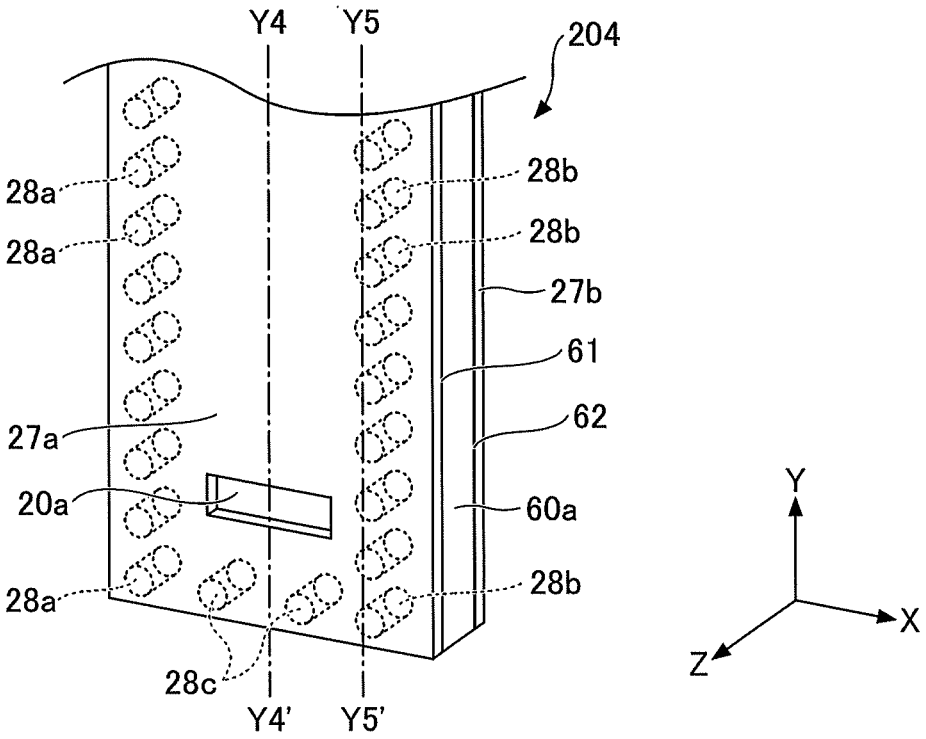
FIG. 9A is a perspective view of a transmission line-attached antenna.
Figure 9B:
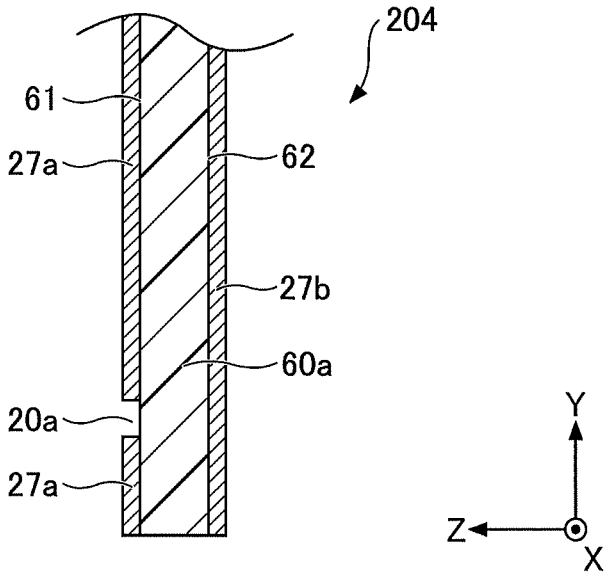
FIG. 9B is a cross-sectional view of a transmission line-attached antenna.
Figure 9C:
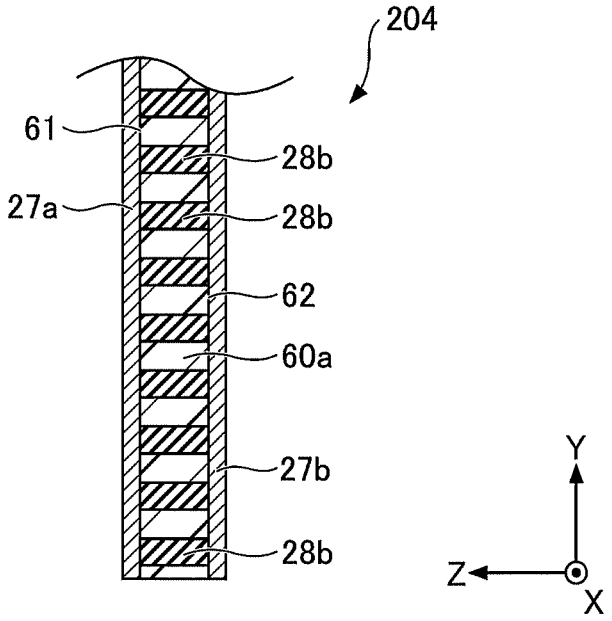
FIG. 9C is a cross-sectional view of a transmission line-attached antenna.

FIG. 9A is a perspective view illustrating a transmission line-attached antenna 204. FIG. 9B is a cross-sectional view taken along Y4-Y4'. FIG. 9C is a cross-sectional view taken along Y5-Y5'. The transmission line-attached antenna 204 is configured such that a transmission line of a signal functions as a substrate integrated waveguide (SIW). The transmission line-attached antenna 204 includes a (first) dielectric substrate 60*a* including a first surface 61 and a second surface 62 opposite to the first surface 61, a first conductor plate 27*a* arranged on the first surface 61, and a second conductor plate 27*b* arranged on the second surface 62. The transmission line-attached antenna 204 is a what is tamed as a slot antenna that has a slot 20*a* formed with an opening in a portion of the first conductor plate 27*a*. In a manner similar to the transmission line-attached antenna 204, the concave portion of the slot 20*a* may be filled with air or a dielectric material other than air.

The transmission line-attached antenna 204 includes conductor walls 28*a*, 28*b*, 28*c* that extend in the thickness direction of the dielectric substrate 60*a* and that are made of conductor materials to connect the first conductor plate 27*a* and the second conductor plate 27*b*. As seen in the thickness direction of the dielectric substrate 60*a* (Z axis direction), the transmission line-attached antenna 204 as illustrated in FIG. 9A includes (a plurality of) conductor walls 28*a* arranged with regular intervals in the Y axis direction, (a plurality of) conductor walls 28*b* arranged substantially parallel to the (plurality of) conductor walls 28*a*, and (a plurality of) conductor walls 28*c* arranged with regular intervals in the X axis direction so as to surround the slot 20*a*. In other words, in the transmission line-attached antenna 204, the transmission line corresponds to the dielectric substrate 60*a* located between (the plurality of) conductor walls 28*a*, (the plurality of) conductor walls 28*b*, and (the plurality of) conductor walls 28*c*. The conductor walls 28*a*, the conductor walls 28*b*, and the conductor walls 28*c* are collectively referred to as "conductor walls 28". The conductor walls 28 are arranged in a U shape so as to surround the slot 20*a* as seen in the thickness direction of the dielectric substrate 60*a* (i.e., the Z axis direction).

The transmission line-attached antenna 204 includes conductor plates (i.e., the first conductor plate 27*a* and the second conductor plate 27*b*) arranged on both of the principal surfaces of the dielectric substrate 60*a* and the conductor walls 28 connecting both of the conductor plates in the thickness direction of the dielectric substrate 60*a*. Because the conductor plates (i.e., the first conductor plate 27*a* and the second conductor plate 27*b*) and the conductor walls 28 are provided, the transmission loss of the transmission line provided in the dielectric substrate 60*a* caused by a dielectric, not illustrated, provided between the first conductor plate 27*a* and the glass plate 70 and caused by the glass plate 70 can be reduced.

Figure 10A:
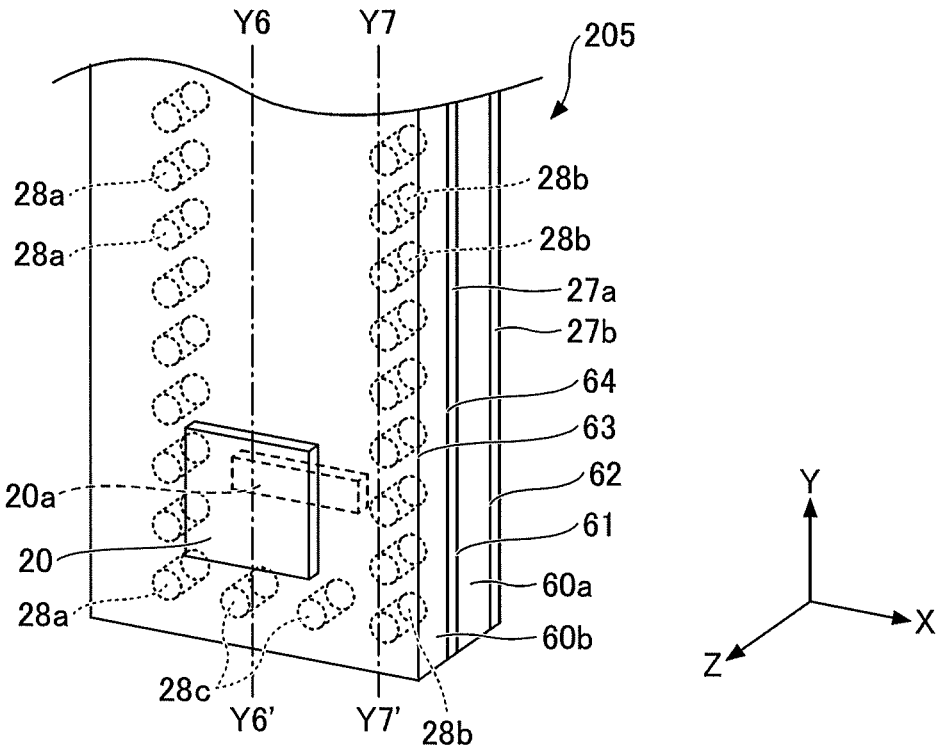
FIG. 10A is a perspective view of a transmission line-attached antenna.
Figure 10B:
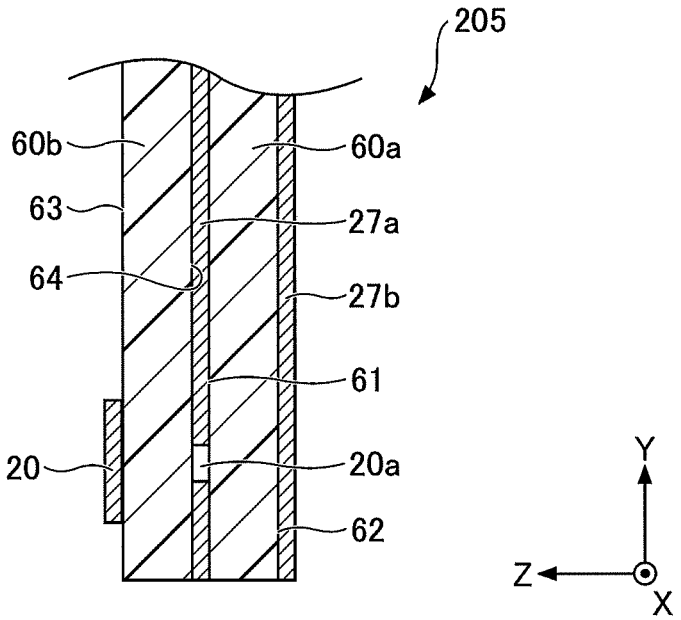
FIG. 10B is a cross-sectional view of a transmission line-attached antenna.
Figure 10C:
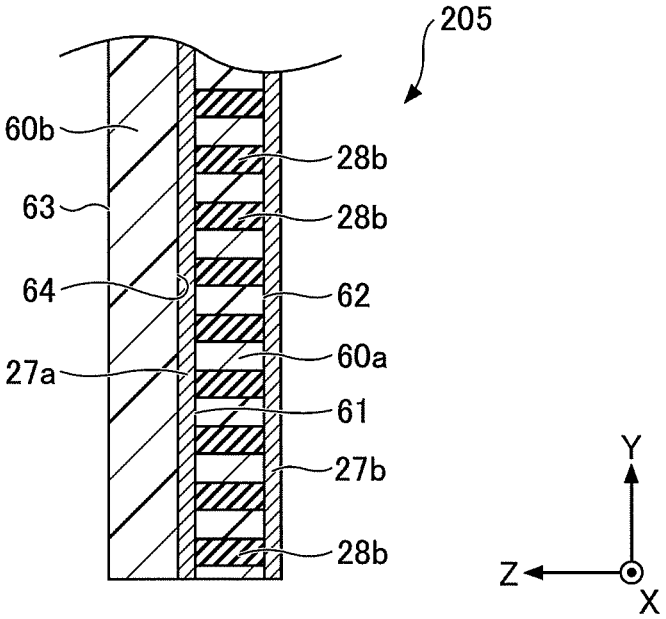
FIG. 10C is a cross-sectional view of a transmission line-attached antenna.

FIG. 10A is a perspective view illustrating a transmission line-attached antenna 205. FIG. 10B is a cross-sectional view taken along Y6-Y6'. FIG. 10C is a cross-sectional view taken along Y7-Y7'. The transmission line-attached antenna 205 includes additional elements in addition to the transmission line-attached antenna 204, and explanation about features similar to the explanation about the transmission line-attached antenna 204 is omitted.

The transmission line-attached antenna 205 includes, as the additional elements, a second dielectric substrate 60*b* and a slot 20*a*. The first dielectric substrate 60*a* and the second dielectric substrate 60*b* are arranged to overlap with each other in the thickness direction. The first dielectric substrate 60*a* includes a first surface 61 on the same side as the second dielectric substrate 60*b* and a second surface 62 on the opposite side from the second dielectric substrate 60*b*. The second dielectric substrate 60*b* includes a third surface 63 on the opposite side from the first dielectric substrate 60*a* and a fourth surface 64 on the same side as the first dielectric substrate 60*a*. The first dielectric substrate 60*a* and the second dielectric substrate 60*b* may be made of different materials or may be made of the same material.

Specifically, the second dielectric substrate 60*b* includes a radiation plate 20 on the third surface 63, and includes a first conductor plate 27*a* on the fourth surface 64. The radiation plate 20 is arranged at a position close to the slot 20*a* as seen in the thickness direction of the first dielectric substrate 60*a* and the second dielectric substrate 60*b* (i.e., the Z axis direction). Like the transmission line-attached antenna 204, the transmission line-attached antenna 205 includes: the conductor plates (i.e., the first conductor plate 27*a* and the second conductor plate 27*b*) on both of the principal surfaces of the first dielectric substrate 60*a*; and the conductor walls 28 connecting both of the conductor plates in the thickness direction of the first dielectric substrate 60*a*. Because the conductor plates (i.e., the first conductor plate 27*a* and the second conductor plate 27*b*) and the conductor walls 28 are provided, the transmission loss of the transmission line provided in the first dielectric substrate 60*a* caused by a dielectric, not illustrated, provided between the radiation plate 20 and the glass plate 70 and caused by the glass plate 70 can be reduced. In the transmission line-attached antenna 205, the radiation unit corresponds to the radiation plate 20.

Other examples of transmission lines include a coplanar line, a conductor-backed coplanar wave guide (CBCPW), a post wall waveguide (PWW), a coplanar strip (CPS), and a slot line.

Figure 11:
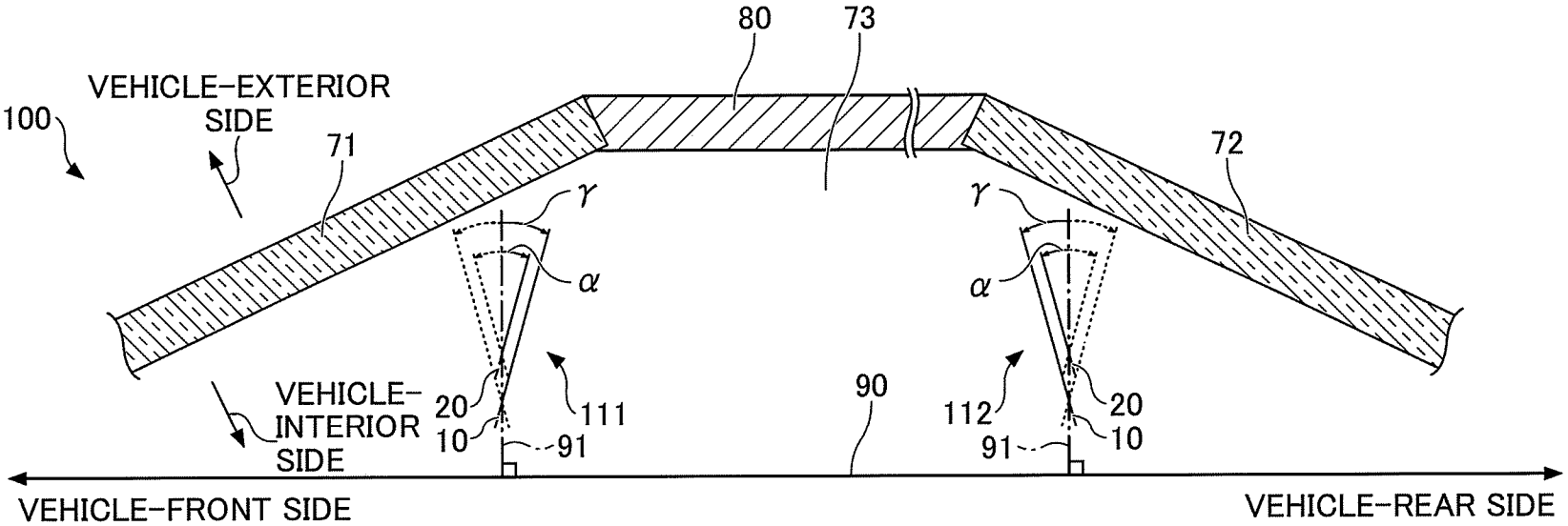
FIG. 11 is a drawing illustrating an example of an antenna system including a plurality of antennas.

FIG. 11 is a partial cross-sectional view of an example of an antenna for a vehicle system having multiple antennas (transmission line-attached antennas). An antenna system 100 as illustrated in FIG. 11 includes a windshield 71, a rear window glass 72, a front antenna 111 attached to the windshield 71, and a rear antenna 112 attached to the rear window glass 72. The windshield 71 and the rear window glass 72 are examples of the glass plate 70 explained above. The front antenna 111 and the rear antenna 112 are examples of the antenna 110 explained above. The front antenna 111 is an example of the first antenna. The rear antenna 112 is an example of the second antenna.

The radiation plate 20 of the front antenna 111 is arranged at a predetermined inclination angle $\alpha$ with respect to a vertical plane 91 perpendicular to the horizontal plane 90. Even in that case, by adjusting the inclination angle $\alpha$ so that the radiation plate 20 is parallel to the interior-side surface of the windshield 71, the front antenna 111 can be easily implemented with a low profile.

Likewise, the radiation plate 20 of the rear antenna 112 is arranged at a predetermined inclination angle with respect to the vertical plane 91 perpendicular to the horizontal plane 90. Even in that case, by adjusting the inclination angle α so that the radiation plate 20 is parallel to the interior-side surface of the rear window glass 72, the rear antenna 112 can be easily implemented with a low profile.

In FIG. 11, the front antenna 111 is arranged away from one of the surfaces of the windshield 71 so that the radiation plate is located on the vehicle front-side with respect to the conductor plate 10. Conversely, the rear antenna 112 is arranged away from one of the surfaces of the rear window glass 72 so that the radiation plate 20 is located on the vehicle rear-side with respect to the conductor plate 10. The front antenna 111 and the rear antenna 112 are attached in this manner, so that the front antenna 111 can ensure the antenna gain in the range in front of the vehicle, the rear antenna 112 can ensure the antenna gain in the range at the rear of the vehicle. Therefore, the antenna gain in the longitudinal direction of the vehicle 80 can be ensured.

The conductor plate 10 of the front antenna 111 is arranged at a predetermined inclination angle γ with respect to the vertical plane 91 perpendicular to the horizontal plane 90. Even in that case, by adjusting the inclination angle γ so that the conductor plate 10 is parallel to the interior-side surface of the windshield 71, the front antenna 111 can be easily implemented with a low profile. This is also applicable to the inclination angle γ of the conductor plate 10 of the rear antenna 112.

"Arranging with an inclination of 0 degrees with respect to the vertical plane 91" means arranging parallel to the vertical plane 91.

In the antenna system 100 as illustrated in FIG. 11, the antenna for the vehicle (i.e., the transmission line-attached antenna) is attached to each of the windshield 71 and the rear window glass 72. Alternatively, the antenna 100 for the vehicle system may include: at least two window glasses selected from the windshield 71, the rear window glass 72, and the side window glass 73; and at least one antenna for the vehicle (i.e., the transmission line-attached antenna) attached to each of the at least two window glasses. Still alternatively, the antenna system 100 may include multiple antennas on the windshield 71, and may include multiple antennas (i.e., transmission line-attached antennas) on the rear window glass 72.

Figure 12:
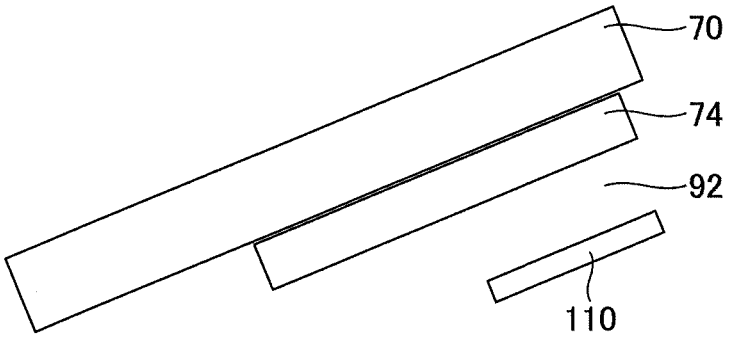
FIG. 12 is an arrangement drawing illustrating a configuration in which a matching layer and air are present between a glass plate and an antenna.

FIG. 12 is an arrangement drawing (i.e., a cross-sectional schematic view in the YZ plane) illustrating a configuration in which a matching layer 74 and air 92 are present between the glass plate 70 and the antenna 110. The matching layer 74 matches the impedance, so that the transmittance of the electromagnetic waves being transmitted through the glass plate 70 and the matching layer 74 can be improved. The matching layer 74 is in contact with one of the surfaces of the glass plate 70. The matching layer 74 is not limited to being in contact with the interior-side surface of the glass plate 70 with an adhesive agent, and the matching layer 74 may be configured to be in contact with the interior-side surface of the glass plate 70 via an attachment member such as a bracket and the like, not illustrated, without any adhesive agent. In a schematic cross-sectional view (i.e., a YZ plane) of FIG. 12, the matching layer 74 has a certain thickness, i.e., a rectangular shape, but the matching layer 74 is not limited thereto. The cross section of the matching layer 74 may be in a shape of a triangle, a trapezoid, or the like, with a surface that is not parallel to the interior-side surface 76 of the glass plate 70 or the antenna 110. Alternatively, for example, the matching layer 74 may be a dielectric lens in a shape of plano-convex, plano-concave, or the like. In this way, the matching layer 74 has a distribution in the thickness, so that the directivity of the antenna can be adjusted according to desired specifications. The aspect of the matching layer 74 with a distribution in the thickness is not limited to FIG. 12, and can also be applied to the explanations of FIG. 13 and FIG. 14 described later.

In the plan view of the glass plate 70, the matching layer 74 may be configured to have an area in which the outer edge of the matching layer 74 is outside of the outer edge of the radiation unit 20 (i.e., the radiation plate 20 or the slot 20*a*). This is because electromagnetic waves from the radiation unit (i.e., the radiation plate 20 or the slot 20*a*) are radiated not only in the thickness direction (i.e., the Z axis direction) of the matching layer 74 but also with a predetermined spread angle with respect to the thickness direction, and accordingly, the effects of the matching layer 74 are also achieved in the direction of the electromagnetic waves radiated with such an angle. Further, in the plan view of the glass plate 70, the matching layer 74 may have an area in which the outer edge of the matching layer 74 is outside of the outer edge of the antenna 110.

The material of the matching layer 74 is not particularly limited, and may be made of an organic material such as resin and an inorganic material such as glass. When the matching layer 74 is resin, the matching layer 74 may be polyethylene terephthalate (PET) resin, cycloolefin resin (COP), acrylic resin, ABS resin, polycarbonate resin, vinyl chloride resin, and the like. Among them, the matching layer 74 may be preferably made of cycloolefin resin due to its heat resistance. Further, when the matching layer 74 is a resin material, the surface of the resin may be coated with an ultraviolet absorbing layer, or an ultraviolet absorber may be added to the resin material in order to increase the ultraviolet resistance.

The dielectric loss tangent (tanδ) of the matching layer 74 is preferably 0.03 or less, so that the gain of the antenna 110 can be improved as compared with the case where the dielectric loss tangent (tanδ) is more than 0.03. The dielectric loss tangent (tanδ) of the matching layer 74 is more preferably 0.02 or less, and still more preferably 0.01 or less, in order to improve the gain of the antenna 110. The lower limit value of the dielectric loss tangent (tanδ) of the matching layer 74 may be more than zero (i.e., the dielectric loss tangent (tanδ) of air).

The matching layer 74 is not limited to be formed with only a dielectric, and may include a meta-material in which a plurality of metal patterns are coated with resin or the like, and the matching layer 74 itself may be composed of the meta-material. The meta-material can be designed to attain a dielectric constant and a magnetic permeability for a specific wavelength, and by applying this feature, the directivity of the antenna 110 can be adjusted to desired specifications. Also, when the matching layer 74 contains a dielectric and a meta-material, the meta-material may be provided on the interior-side surface 76 of the glass plate 70 with respect to the dielectric, or may be provided on the side of the antenna 110 with respect to the dielectric. In a case where the spacer 75 explained below is provided, the meta-material may be arranged on the surface of the spacer 75.

For example, the meta-material may have a configuration capable of active control for changing the dielectric constant of the metal pattern by using an electric control circuit. In this way, with the configuration capable of the active control, the meta-material can adjust the directivity of the antenna 110 to a desired state according to the situation.

The matching layer 74 is not limited to be formed with only the dielectric, and may include a director. With the director controlling the phase of electromagnetic waves, the directivity of the antenna 110 can be adjusted.

Further, the matching layer 74 is not limited to be formed with only the dielectric, and may include a frequency selective surface (FSS) constituted by a conductor (metal) pattern. Alternatively, the matching layer 74 itself may be constituted by a frequency selective surface. The frequency selective surface has openings (that do not have conductors) on the conductor surface, and can selectively transmit electromagnetic waves at a predetermined frequency with the pattern of the openings, so that a particular frequency transmitted and received by the antenna 110 can be selected more suitably for a desired range. When the matching layer 74 includes a dielectric and a frequency selective surface, the frequency selective surface may be provided on the interior-side surface 76 of the glass plate 70 with respect to the dielectric, or may be provided on the side of the antenna 110 with respect to the dielectric. In a case where the spacer 75 explained below is provided, the frequency selective surface may be arranged on the surface of the spacer 75. The frequency selective surface matches the impedance, so that the transmittance of the electromagnetic waves being transmitted through the glass plate 70 and the matching layer 74 can be improved.

Figure 13:
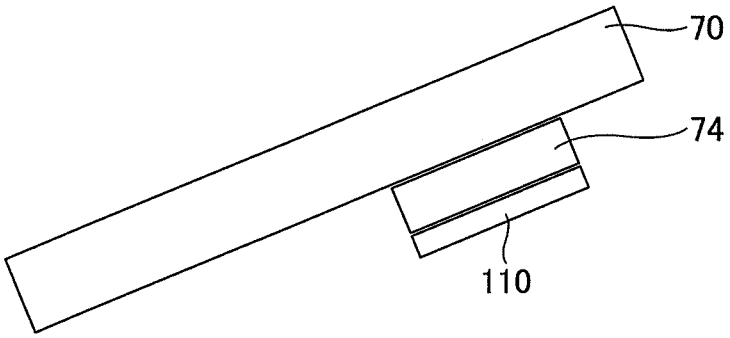
FIG. 13 is an arrangement drawing illustrating a configuration in which a matching layer is present between the glass plate and the antenna.

FIG. 13 is an arrangement drawing illustrating a configuration in which the matching layer 74 is present between the glass plate 70 and the antenna 110. In FIG. 13, air is not present between the glass plate 70 and the antenna 110. The matching layer 74 includes a first matching surface in contact with one of the surfaces of the glass plate 70 and a second matching surface in contact with the antenna 110. A preferable range of the dielectric loss tangent of the matching layer 74 is the same as described above. In FIG. 13, in the plan view of the glass plate 70 (i.e., as seen in the Z axis direction), the matching layer 74 and the antenna 110 are illustrated as the same area, but due to a reason similar to the reason explained with reference to FIG. 12, in the plan view, the matching layer 74 may have an area in which the outer edge of the matching layer 74 is outside of the outer edge of the radiation unit 20 (i.e., the radiation plate 20 or the slot 20*a*). Further, in the plan view, the matching layer 74 may have an area in which the outer edge of the matching layer 74 is outside of the outer edge of the antenna 110.

Figure 14:
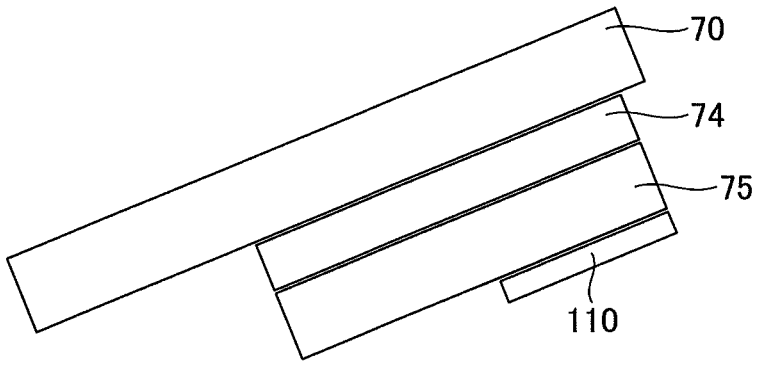
FIG. 14 is an arrangement drawing illustrating a configuration in which a matching layer and a spacer are present between the glass plate and the antenna.

FIG. 14 is an arrangement drawing illustrating a configuration in which the matching layer 74 and the spacer 75 are provided between the glass plate 70 and the antenna 110. In FIG. 14, air is not present between the glass plate 70 and the antenna 110, but air may be present between the glass plate 70 and the antenna 110. Also, the matching layer 74 may not be provided. The matching layer 74 includes a first matching surface in contact with one of the surfaces of the glass plate 70 and a second matching surface in contact with the spacer 75. A preferable range of the dielectric loss tangent of the matching layer 74 is the same as described above. The spacer 75 is a distance adjustment member for adjusting the distance from the glass plate 70 to the antenna 110. The spacer 75 not only has a shape for adjusting the distance, but also can achieve a function similar to the matching layer by using a material capable of adjusting the impedance. The spacer 75 illustrated in FIG. 14 includes a first spacer surface in contact with the matching layer 74 and a second spacer surface in contact with the antenna 110. However, the spacer 75 is not limited to the spacer illustrated in FIG. 14, and may have, for example, a tubular structure having a predetermined thickness of a peripheral wall and famed with a through hole in the center.

In FIG. 14, due to a reason similar to the reason explained with reference to FIG. 12, in the plan view of the glass plate 70 (i.e., as seen in the Z axis direction), the spacer 75 and the matching layer 74 preferably have an area in which the outer edge of the spacer 75 and of the matching layer 74 is outside of the radiation unit (i.e., the radiation plate 20 or the slot 20*a*). In other words, electromagnetic waves from (the radiation plate 20 of) the antenna 110 are radiated not only in the thickness direction (i.e., the Z axis direction) of the spacer 75 and the matching layer 74 but also with a predetermined spread angle with respect to the thickness direction. Therefore, with the spacer 75 and the matching layer 74, the radiation efficiency can be enhanced even in the direction in which the electromagnetic waves are radiated at such an angle. Further, in the plan view, the spacer 75 and the matching layer 74 may be configured to have an area in which the outer edge of the spacer 75 and of the matching layer 74 is outside of the outer edge of the antenna 110.

The dielectric loss tangent (tanδ) of the spacer 75 is preferably 0.03 or less, so that the gain of the antenna 110 can be improved as compared with the case where the dielectric loss tangent (tanδ) is more than 0.03. In order to more greatly improve the gain of the antenna 110, the dielectric loss tangent (tanδ) of the spacer 75 is more preferably 0.02 or less, and is still more preferably 0.01 or less. The lower limit value of the dielectric loss tangent (tanδ) of the spacer 75 may be more than zero (i.e., the dielectric loss tangent (tanδ) of air).

The material of the spacer 75 is not particularly limited, and in a manner similar to the matching layer 74 explained above, the material of the spacer 75 may be made of an organic material such as resin and an inorganic material such as glass. When the spacer 75 is a resin material, in a manner similar to the matching layer 74, the surface of the resin may be coated with an ultraviolet absorbing layer, or an ultraviolet absorber may be added to the resin material in order to increase the ultraviolet resistance.

When the relative dielectric constant of the spacer 75 is 10 or less, the gain of the antenna 110 can be ensured. When the relative dielectric constant of the spacer 75 is equal to or less than the relative dielectric constant of the glass plate 70, the antenna 110 can be easily designed as compared with the case where the relative dielectric constant of the spacer 75 is more than the relative dielectric constant of the glass plate 70. For example, the relative dielectric constant of the glass plate 70 is 5 or more and is 9 or less, and accordingly, the relative dielectric constant of the spacer 75 is preferably 1.5 or more and 7 or less, and more preferably 2 or more and 5 or less. Unless otherwise specified, in the present specification, the relative dielectric constant is a value at a frequency of 28 GHz.

Figure 15:
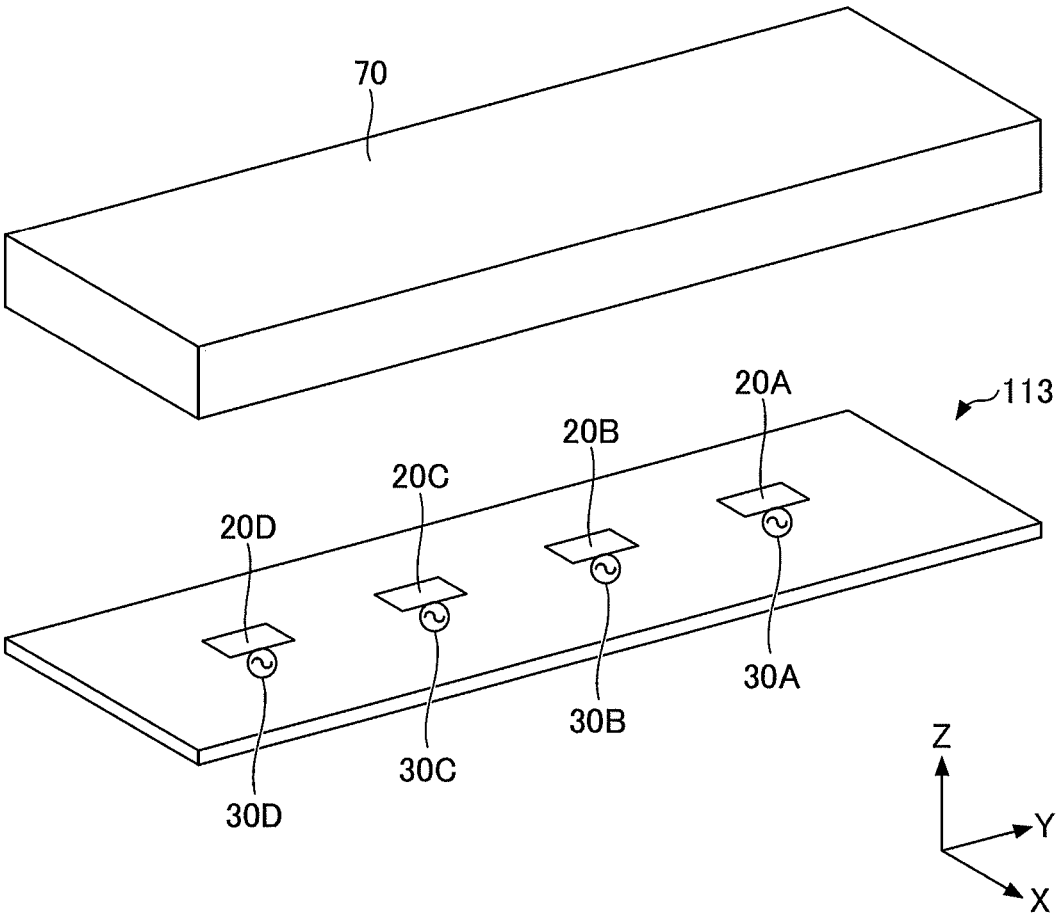
FIG. 15 is a drawing illustrating an example of an antenna system having an array antenna.
Figure 16:
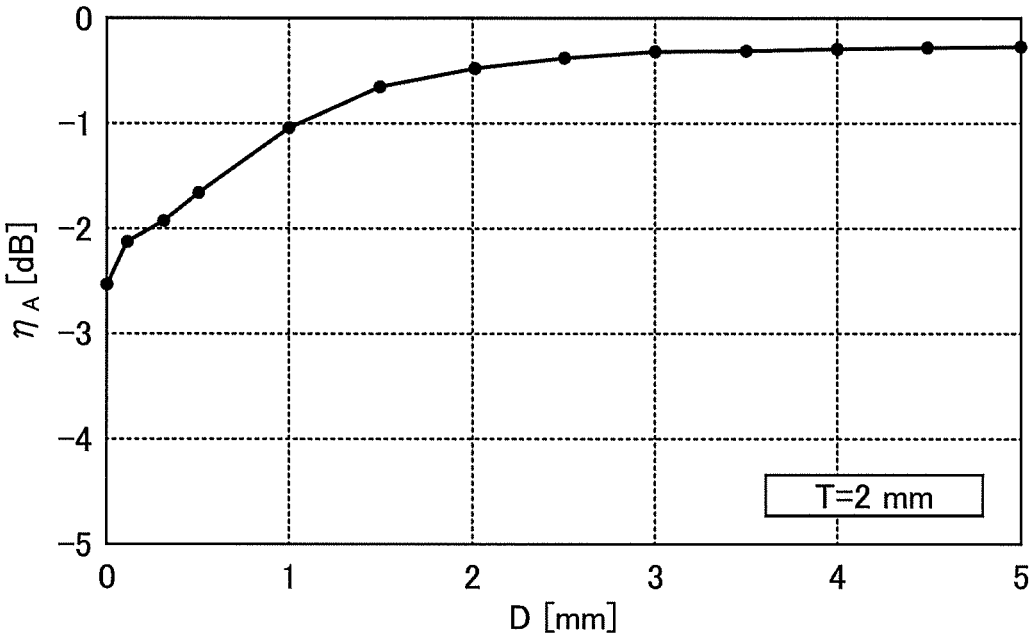
FIG. 16 is a graph illustrating an example of a change in a radiation efficiency according to a distance between an antenna and a glass plate with a plate thickness of 2 mm.
Figure 17:
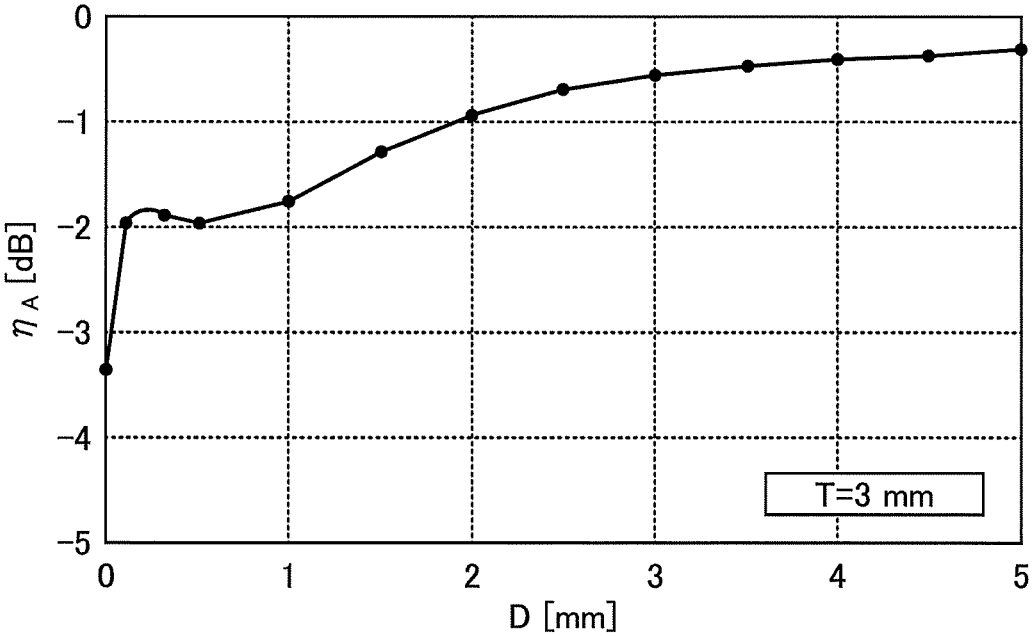
FIG. 17 is a graph illustrating an example of a change in a radiation efficiency according to a distance between an antenna and a glass plate with a plate thickness of 3 mm.
Figure 18:
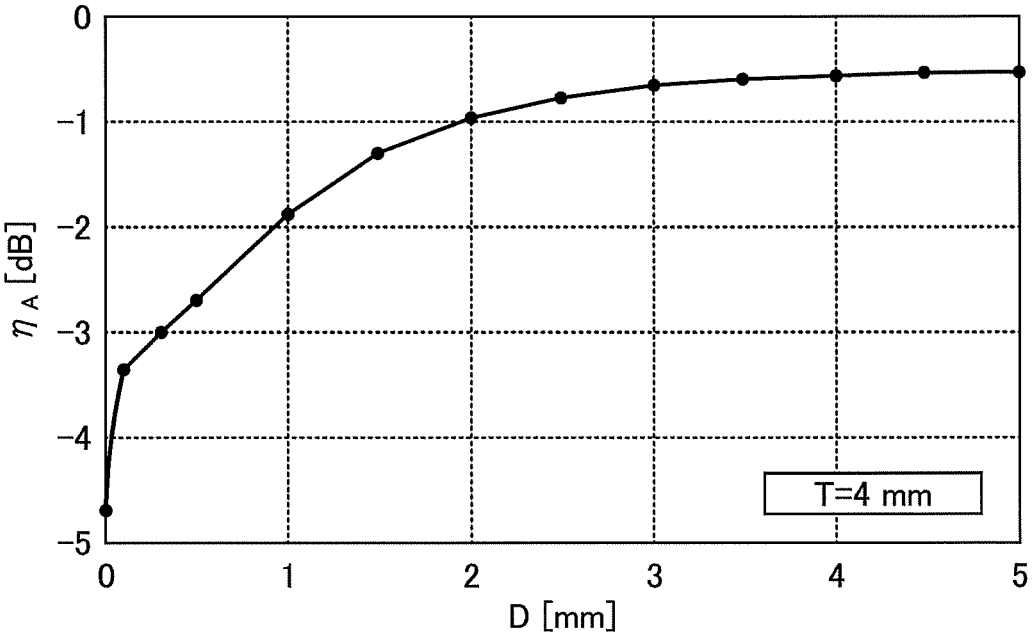
FIG. 18 is a graph illustrating an example of a change in a radiation efficiency according to a distance between an antenna and a glass plate with a plate thickness of 4 mm.
Figure 19:
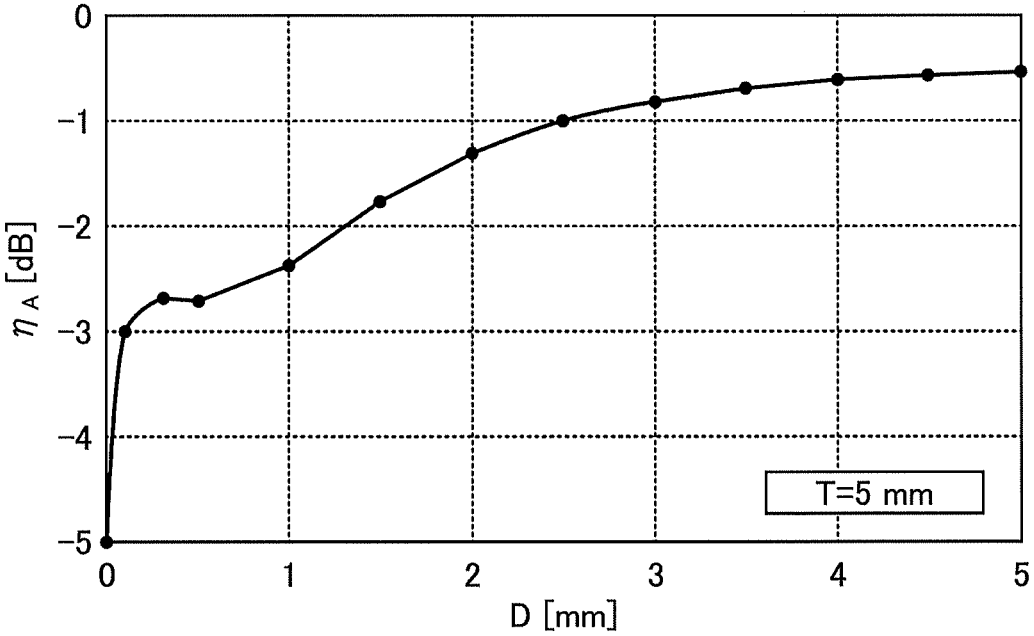
FIG. 19 is a graph illustrating an example of a change in a radiation efficiency according to a distance between an antenna and a glass plate with a plate thickness of 5 mm.

FIG. 15 is a drawing illustrating an example of an antenna system having an array antenna. An antenna (i.e., a transmission line-attached antenna) located away from one of the surfaces of the glass plate 70 may be an array antenna in which a plurality of antenna elements are arranged. FIG. 15 illustrates an array antenna 113 in which four antenna elements 20A, 20B, 20C, and 20D are arranged in the Y axis direction. The array antenna 113 includes multiple antennas, in an array form, having a configuration similar to the configuration of the antenna 110 explained above. Each of the antenna elements 20A, 20B, 20C, and 20D has a configuration similar to the radiation plate 20 or the slot 20*a* explained above. Each of the feeding portions 30A, 30B, 30C, and 30D has a configuration similar to the feeding portion 30 explained above.

Because the antenna (i.e., the transmission line-attached antenna) located away from one of the surfaces of the glass plate 70 is the array antenna in which the plurality of antenna elements are arranged, the radiation range of the antenna (the directivity of the antenna) can be expanded.

FIGS. 16 to 19 are graphs illustrating examples of changes in the radiation efficiency $\eta_A$ of electromagnetic waves at 28 GHz according to the distance D between the antenna 110 and the glass plate 70, when the plate thickness T of the glass plate 70 was 2, 3, 4, 5 mm, respectively. FIGS. 16 to 19 illustrate data measured by a simulation. The medium constituting the distance D was air. In this case, in the simulation, the sizes of respective portions of the antenna 110 illustrated in FIG. 4 were as follows, in units of millimeters.

L60: 10
L61: 10
L62: 0.2
L20: 2.6
L21: 2.6

The shortest distance from the connection point 22 to one side of the radiation plate 20 in the square shape was 0.9 mm. The relative dielectric constant of the dielectric substrate 60 for electromagnetic waves at 28 GHz was 3.79. In the simulation, the shape of the glass plate 70 was a square with a length of 50 mm and a width of 50 mm. For electromagnetic waves at 28 GHz, the glass plate 70 had a relative dielectric constant of 6.8 and a dielectric loss tangent of 0.01. In this case, the simulation was performed under a condition that the surface of the radiation plate 20 and the interior-side surface of the glass plate 70 were arranged parallel to each other, and at any position, the distance therebetween was the distance D.

As shown in FIGS. 16 to 19, as the distance D decreases, the radiation efficiency $\eta_A$ tends to decrease. When compared with the same distance D, the radiation efficiency $\eta_A$ decreases more greatly as the plate thickness T increases. The measurement data shown in FIGS. 16 to 19 indicates that radiation efficiencies $\eta_A$ satisfying "$\eta_A \geq \eta_0 + (\eta_{\lambda g/2} - \eta_0) \times 0.1$" explained above have been attained. Although FIG. 16 to FIG. 19 illustrate characteristics of electromagnetic waves at the frequency of 28 GHz, the wavelength decreases as the frequency increases, and accordingly, the value of the distance D satisfying "$\eta_A \geq \eta_0 + (\eta_{\lambda g/2} - \eta_0) \times 0.1$" decreases. In other words, when the frequency of the electromagnetic waves transmitted and received is high, the distance D can be reduced, and accordingly, the antenna 110 can be brought closer to the glass plate 70, and the antenna system can be easily implemented with a low profile.

Figure 20A:
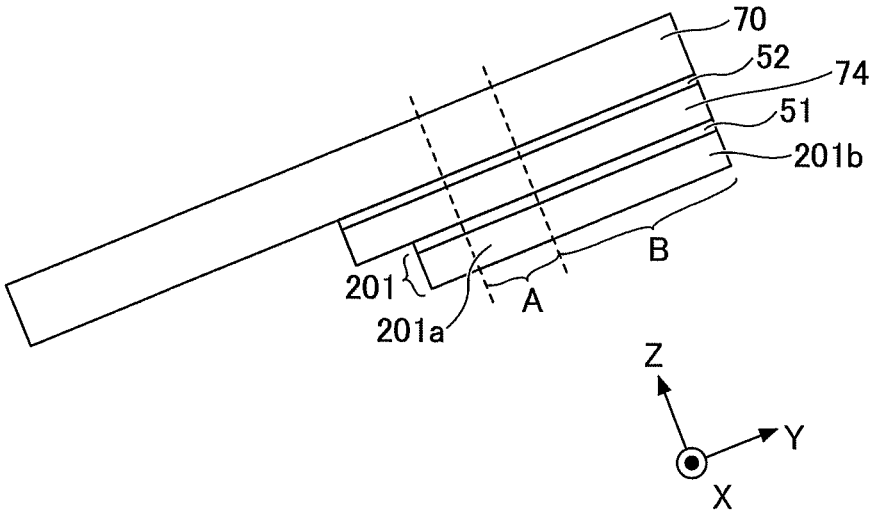
FIG. 20A is an arrangement drawing illustrating a configuration in which a matching layer is present between a glass plate and a transmission line-attached antenna.

Next, a simulation model of a loss (transmission loss) that occurs in a transmission line of a transmission line-attached antenna is explained with reference to FIG. 20A and FIG. 20B. FIG. 20A illustrates a configuration in which a transmission line-attached antenna 201 is attached to a glass plate 70 via a matching layer 74, and includes a first adhesive member 51 connecting the transmission line-attached antenna 201 and the matching layer 74 and a second adhesive member 52 connecting the glass plate 70 and the matching layer 74. In FIG. 20A, areas are divided such that an area A is an area including a planar antenna of the transmission line-attached antenna 201, and an area B is an area including a transmission line of the transmission line-attached antenna 201. In other words, the transmission line-attached antenna 201 includes an antenna area 201*a* included in the area A and a transmission line area 201*b* included in the area B.

Figure 20B:
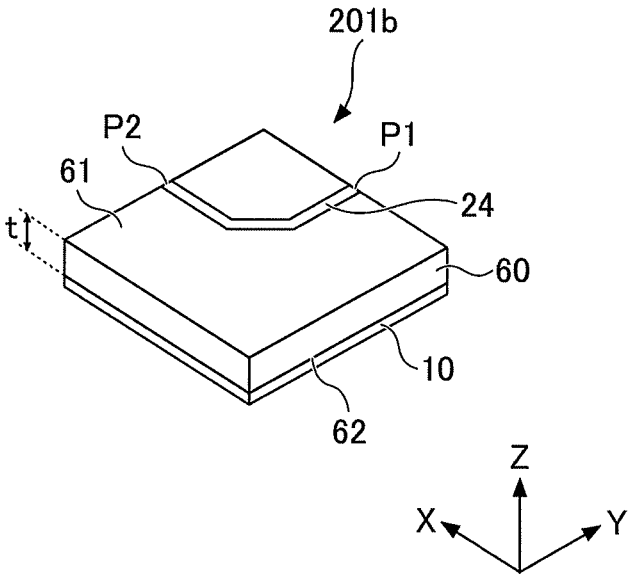
FIG. 20B is a perspective view illustrating a transmission line area of a transmission line-attached antenna.

FIG. 20B is a perspective view illustrating only the transmission line area 201*b* of the transmission line-attached antenna 201 from among the area B. The transmission line area 201*b* includes a dielectric substrate 60, a microstrip line 24 serving as a transmission line on the first surface 61 of the dielectric substrate 60, and a conductor plate 10 provided on the second surface 62 to function as a ground. In this simulation model, the transmission characteristic (S21) of the transmission line with respect to the frequency was simulated under the same condition except that the thickness (t) of the dielectric substrate 60 was changed in the area B, i.e., the structure in which the transmission line area 201*b* of the transmission line-attached antenna 201, the first adhesive member 51, the matching layer 74, the second adhesive member 52, and the glass plate 70 are stacked in this order. Specifically, the thickness (t) of the dielectric substrate 60 was changed to 0.2 mm (0.027×λ0'), 0.4 mm (0.053×λ0'), 0.6 mm (0.080×λ0'), 0.8 mm (0.11×λ0'), and 1.0 mm (0.13×λ0'). Herein, λ0' denotes a wavelength (approximately 7.5 mm) in a vacuum at 40 GHz. The conditions of this simulation were as follows.

TABLE 1

| | Thickness [mm] | Relative dielectric constant |
|---|---|---|
| Glass plate 70 | 3.0 | 6.8 |
| Second adhesive member 52 | 0.5 | 2.5 |
| Matching layer 74 | 5.0 | 3.0 |
| First adhesive member 51 | 0.5 | 2.5 |
| Dielectric substrate 60 | 0.2 to 1.0 | 3.79 |

In this case, the simulation was performed while the matching layer 74 was assumed to be a cycloolefin polymer (COP) and the dielectric substrate 60 was assumed to be synthetic fused silica glass (manufactured by AGC Inc. under the tradename of "AQ Series"). The transmission line area 201*b* as illustrated in FIG. 20B was in a quadrangular shape with a size of 10 mm by 10 mm in the XY plane. The microstrip line 24 had a width of 0.25 mm, and included a straight line with a length of 3.5 mm in parallel to the X axis direction, a straight line with a length of 3.5 mm in parallel to the Y axis direction, and a straight line connecting these two straight lines and having a length of 2.1 mm at an angle of 45 degrees with respect to the X axis and the Y axis. In other words, the microstrip line 24 was a line the entire length of which was about 9.1 mm and which had two bending points bent by 135 degrees in the XY plane.

Figure 21:
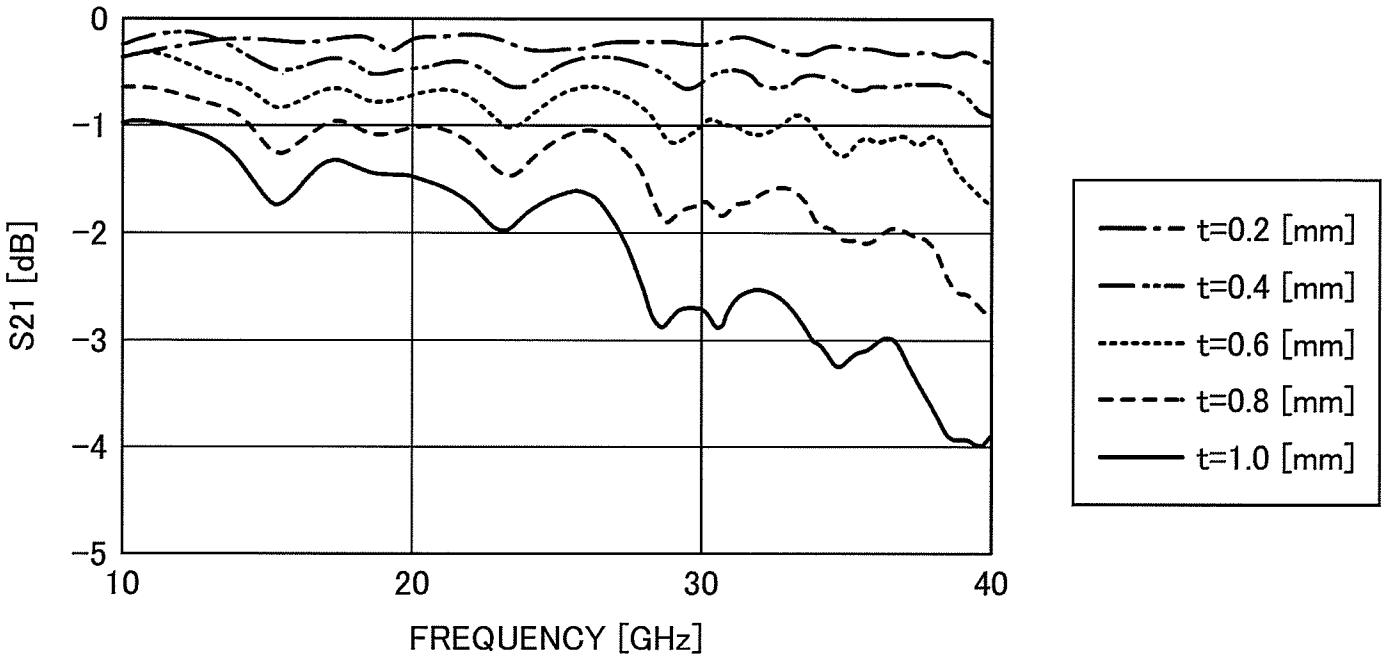
FIG. 21 is a graph illustrating an example of a change in a transmission loss of a transmission line according to a thickness of a dielectric substrate.

FIG. 21 is a graph showing transmission losses (S21 in units of [dB]) that occur in the microstrip line 24 in the laminate referred to as the area B when signals were transmitted between both ends of the microstrip line 24 of FIG. 20B, i.e., in a path from a point P1 to a point P2. As shown in FIG. 21, as the thickness of the dielectric substrate 60 (the synthetic fused silica glass) decreases, the transmission loss (the value of S21) decreases, and further, the characteristic S21 for the frequency of 10 GHz or more becomes more stable (the fluctuation decreases). Hereinabove, the antenna system has been explained with reference to the embodiment, but the present invention is not limited to the above embodiment. Various modifications and improvements, such as combinations and replacements with a part or all of another embodiment, can be made within the scope of the claimed subject matter.

For example, the glass plate is not limited to a glass plate for a vehicle, and may be glass plates for buildings or electronic devices.

What is claimed is:

1. An antenna system comprising:

a glass plate having a thickness of 1.1 mm or more and having a dielectric loss tangent of 0.005 or more at 28 GHz; and an antenna located away from one of surfaces of the glass plate, wherein a ratio of electric power radiated from the antenna to electric power input into the antenna is defined as a radiation efficiency, and wherein where an effective wavelength of an electromagnetic wave at a predetermined frequency that is 10 GHz or more is denoted as λg, and where the radiation efficiency is denoted as $\eta_0$ [dB] when the glass plate and the antenna are in contact with each other, and is denoted as $\eta_{\lambda g/2}$ [dB] when a distance between the one of the surfaces and the antenna is λg/2, the glass plate and the antenna are arranged so as to obtain the radiation efficiency of $\eta_A$ [dB] that satisfies $\eta_A \geq \eta_0 + (\eta_{\lambda g/2} - \eta_0) \times 0.1$.

2. The antenna system according to claim 1, wherein the glass plate and the antenna are arranged so that the radiation efficiency of $\eta_A$ attains −10 [dB] or more.

3. The antenna system according to claim 1, wherein the antenna is a planar antenna arranged parallel to the one of the surfaces.

4. The antenna system according to claim 1, further comprising:

a matching layer located between the glass plate and the antenna, the matching layer being different from air, wherein the matching layer has a dielectric loss tangent of 0.03 or less at 28 GHz.

5. The antenna system according to claim 4, wherein the antenna includes a radiation unit configured to radiate the electromagnetic wave at the predetermined frequency, and wherein in a plan view of the glass plate, an outer edge of the matching layer is outside of an outer edge of the radiation unit.

6. The antenna system according to claim 5, wherein in the plan view of the glass plate, the outer edge of the matching layer is outside of an outer edge of the antenna.

7. The antenna system according to claim 5, wherein the radiation unit is a radiation plate made of a conductor material.

8. The antenna system according to claim 5, wherein the radiation unit is a slot.

9. The antenna system according to claim 4, wherein the matching layer is in contact with the one of the surfaces of the glass plate via an adhesive agent, or is in contact with the one of the surfaces of the glass plate without the adhesive agent.

10. The antenna system according to claim 4, wherein the matching layer and air are interposed between the glass plate and the antenna.

11. The antenna system according to claim 4, wherein the matching layer includes a frequency selective surface constituted by a conductor pattern.

12. The antenna system according to claim 4, wherein the matching layer includes a meta-material.

13. The antenna system according to claim 4, wherein the matching layer is a dielectric lens.

14. The antenna system according to claim 1, comprising:

a spacer located between the glass plate and the antenna and having a relative dielectric constant different from air, wherein the spacer has a dielectric loss tangent of 0.03 or less at 28 GHz.

15. The antenna system according to claim 14, wherein the antenna includes a radiation unit configured to radiate an electromagnetic wave of the predetermined frequency, and in a plan view of the glass plate, an outer edge of the spacer is outside of an outer edge of the radiation unit.

16. The antenna system according to claim 15, wherein in the plan view of the glass plate, the outer edge of the spacer is outside of an outer edge of the antenna.

17. The antenna system according to claim 14, wherein the spacer has a relative dielectric constant of 10 or less at 28 GHz.

18. The antenna system according to claim 1, wherein a medium between the glass plate and the antenna is constituted by air.

19. The antenna system according to claim 1, wherein where a wavelength of the electromagnetic wave at the predetermined frequency of 10 GHz or more in air is denoted as λ0, a distance between the glass plate and the antenna is 2×λ0 or less.

20. The antenna system according to claim 1, wherein the antenna is an array antenna in which a plurality of antenna elements are arranged.

21. The antenna system according to claim 1, wherein the glass plate has a relative dielectric constant of 5 or more and of 9 or less at 28 GHz.

22. The antenna system according to claim 1, comprising:

a transmission line-attached antenna including the antenna and a transmission line for feeding the antenna.

23. The antenna system according to claim 22, wherein the antenna includes a dielectric substrate, the transmission line is provided on a first surface of the dielectric substrate, a conductor plate is provided on a second surface on an opposite side of the dielectric substrate from the first surface, and where a wavelength of the electromagnetic wave at the predetermined frequency of 10 GHz or more in air is denoted as λ0, the dielectric substrate has a thickness of 0.1×λ0 or less.

* * * * *